US008368620B2

(12) United States Patent
Izawa et al.

(10) Patent No.: US 8,368,620 B2
(45) Date of Patent: Feb. 5, 2013

(54) ORGANIC ELECTROLUMINESCENCE DISPLAY PANEL AND METHOD OF DRIVING THE SAME

(75) Inventors: Yosuke Izawa, Osaka (JP); Mika Nakamura, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/357,854

(22) Filed: Jan. 25, 2012

(65) Prior Publication Data

US 2012/0188221 A1 Jul. 26, 2012

Related U.S. Application Data

(63) Continuation of application No. PCT/JP2010/006597, filed on Nov. 10, 2010.

(51) Int. Cl.
*G09G 3/30* (2006.01)

(52) U.S. Cl. ..... 345/76; 345/77; 345/89; 345/690; 345/211

(58) Field of Classification Search ..... 345/76–81, 345/212

See application file for complete search history.

(56) References Cited

U.S. PATENT DOCUMENTS

| | | | | |
|---|---|---|---|---|
| 6,864,637 | B2 | 3/2005 | Park et al. | |
| 6,888,318 | B2 | 5/2005 | Childs | |
| 8,077,173 | B2 | 12/2011 | Mori et al. | |
| 8,144,142 | B2 | 3/2012 | Yamate | |
| 2003/0111964 | A1 | 6/2003 | Childs | |
| 2004/0004443 | A1 | 1/2004 | Park et al. | |
| 2008/0238833 | A1 * | 10/2008 | Hioki et al. | 345/76 |
| 2009/0102759 | A1 * | 4/2009 | Kawabe | 345/76 |

(Continued)

FOREIGN PATENT DOCUMENTS

| | | |
|---|---|---|
| JP | 2001-34231 | 2/2001 |
| JP | 2004-94211 | 3/2004 |

(Continued)

OTHER PUBLICATIONS

U.S. Appl. No. 13/424,854 to Rie Odawara et al., which was filed Mar. 20, 2012.
U.S. Appl. No. 13/421,948 to Shinya Ono, which was filed Mar. 16, 2012.
U.S. Appl. No. 13/421,990 to Shinya Ono, which was filed Mar. 16, 2012.
U.S. Appl. No. 13/422,124 to Shinya Ono, which was filed Mar. 16, 2012.

*Primary Examiner* — Amare Mengistu
*Assistant Examiner* — Gloryvid Figueroa-Gibson
(74) *Attorney, Agent, or Firm* — Greenblum & Bernstein, P.L.C.

(57) ABSTRACT

An organic EL display panel includes: a P-type drive transistor having a gate connected to a capacitor and a drain connected to an organic EL element; an N-type drive transistor having a gate connected to the capacitor and a source connected to the organic EL element; a first power source line for applying a first voltage to the P-type drive transistor; a second power source line for applying, to the N-type drive transistor, a second voltage higher than the first voltage. The P-type drive transistor has characteristics such that a first gate voltage value corresponding to a predetermined current value in current-voltage characteristics of the organic EL element is a minimum voltage of the data voltage, and the N-type drive transistor has characteristics such that a second gate voltage value corresponding to the predetermined current value is greater than a third gate voltage value corresponding to a minimum current value of the organic EL element.

11 Claims, 17 Drawing Sheets

U.S. PATENT DOCUMENTS

| | | | | |
|---|---|---|---|---|
| 2009/0160741 | A1* | 6/2009 | Inoue et al. | 345/76 |
| 2009/0244110 | A1 | 10/2009 | Ogura | |
| 2010/0039426 | A1 | 2/2010 | Matsumoto et al. | |
| 2010/0149140 | A1 | 6/2010 | Nakamura et al. | |
| 2010/0259527 | A1 | 10/2010 | Odawara et al. | |
| 2010/0309356 | A1 | 12/2010 | Ihara et al. | |
| 2011/0181192 | A1 | 7/2011 | Ono | |
| 2011/0234911 | A1 | 9/2011 | Nakamura | |
| 2011/0242087 | A1 | 10/2011 | Ebisuno et al. | |
| 2012/0050350 | A1 | 3/2012 | Matsui | |

FOREIGN PATENT DOCUMENTS

| | | |
|---|---|---|
| JP | 2005-513536 | 5/2005 |
| JP | 2008-89726 | 4/2008 |
| JP | 2008-134611 | 6/2008 |
| JP | 2009-244342 | 10/2009 |
| JP | 2009-251546 | 10/2009 |

* cited by examiner

ORGANIC ELECTROLUMINESCENCE DISPLAY PANEL AND METHOD OF DRIVING THE SAME

CROSS REFERENCE TO RELATED APPLICATION

This is a continuation application of PCT application No. PCT/JP2010/006597 filed on Nov. 10, 2010, designating the United States of America.

BACKGROUND OF THE INVENTION (1) Field of the Invention

The present invention relates to an organic electroluminescence display panels and methods of driving the same, and particularly relates to an organic electroluminescence display panel that uses an active-matrix drive circuit and to a method of driving the same.

(2) Description of the Related Art

Display panels using organic electroluminescence (EL) elements are known as display panels that use current-driven luminescence elements. An organic EL display panel that uses such self-luminous organic EL elements does not require backlights that are needed in liquid crystal display panels, and is thus well-suited for increasing device thinness. Furthermore, since viewing angle is not restricted, practical application thereof as a next-generation display panel is expected. Furthermore, the organic EL elements used in the organic EL display panel are different from liquid crystal cells which are controlled according to the voltage applied thereto, in that the luminance of the respective luminescence elements is controlled according to the value of the current flowing thereto.

In organic EL display devices, organic EL elements included in pixels are normally arranged in a matrix. In an organic EL display referred to as a passive-matrix organic EL display, an organic EL element is provided at each crosspoint between row electrodes (scanning lines) and column electrodes (data lines), and such organic EL elements are driven by applying a voltage equivalent to a data signal, between a selected row electrode and the column electrodes.

On the other hand, in an organic EL display panel referred to as an active-matrix organic EL display device, a switching thin film transistor (TFT) is provided in each crosspoint between scanning lines and data lines, the gate of a drive element is connected to the switching TFT, the switching TFT is turned ON through a selected scanning line so as to input a data signal from a signal line to the drive TFT, and an organic EL element is driven by such drive TFT.

Unlike in the passive-matrix organic EL display panel where, only during the period in which each of the row electrodes (scanning lines) is selected, does the organic EL element connected to the selected row electrode produce luminescence, in the active-matrix organic EL display panel, it is possible to cause the organic EL element to produce luminescence until a subsequent scan (selection), and thus a reduction in display luminance is not incurred even when the number of scanning lines increases. With this point, the active-matrix driving method has an advantage in realizing a large-screen and high-definition display panel.

On the other hand, in an organic EL display panel using current-driven organic EL elements, the luminescence production operation is performed according to the flow of current to the organic EL element included in each pixel, and thus the power consumption of the display panel tends to increase compared to a liquid crystal element which is a voltage-driven element. In particular, the power consumption of the display panel increases following increases in screen size and level of high-definition.

Japanese Unexamined Patent Application Publication No. 2008-89726 (Patent Reference 1) discloses a circuit configuration that reduces the power consumption of pixel units in an active-matrix organic EL display device.

FIG. 17 is a circuit diagram showing an example of a specific circuit configuration of a pixel circuit included in an organic EL display device disclosed in Patent Reference 1. As shown in the figure, a luminescence pixel 100A includes: a selection transistor 121*b* for writing the voltage of a data line 112 into a holding capacitor element 124*b* when the luminescence pixel 100A is selected according to a scanning signal of a scanning line 111; the holding capacitor element 124*b*; a P-type drive transistor 122 which supplies a drive current corresponding to the held voltage of the holding capacitor element 124*b*, from a high-luminance power source line 113 or a low-luminance power source line 114; and an organic EL element 125 which produces luminescence according to the flow of such drive current. The above-described pixel configuration is a configuration that is included in a normal pixel circuit.

In addition, the luminescence pixel 100A includes: a switching transistor 123 turns the high-luminance power source voltage from the high-luminance power source line 113 ON and OFF; a diode 126 which turns the low-luminance power source voltage from the low-luminance power source line 114 ON and OFF; a holding capacitor element 124*a* which has one terminal connected to the high-luminance power source line 113 and the terminal connected to the gate of the switching transistor 123; and a selection transistor 121*a* which has a gate connected to the scanning line 111, and inputs a control signal VELS to the gate of the switching transistor 123 when the luminescence pixel 100A is selected according to the scanning signal from the scanning line 111. The source of the switching transistor 123 and the cathode of the diode 126 are connected, and the source of the P-type drive transistor 122 is connected to such common connection point.

The above-described switching transistor 123, selection transistor 121*a*, holding capacitor element 124*a*, and diode 126 compose a power source voltage switching unit for switching between the use of either the high-luminance power source voltage or the low-luminance power source voltage, as the pixel power source voltage to be supplied to the P-type drive transistor 122.

In the above-described circuit configuration, when the high-luminance power source voltage is selected, the scanning signal and the control signal VELS simultaneously switch to the high level in the writing period. In this case, the switching transistor 123 turns ON, and the high-luminance power source voltage is supplied to the source of the P-type drive transistor 122. At this time, the diode 126 becomes reverse-biased and automatically turns OFF because the anode potential becomes the low-luminance power source voltage level and the cathode potential becomes the high-luminance power source voltage level, and thus the power source voltage from the low-luminance power source line 114 is cut-off.

On the other hand, when the low-luminance power source voltage is selected, the scanning signal switches to the high level and the control signal VELS stays in the low level in the writing period. In this case, the switching transistor 123 turns OFF, and the power source voltage from the high-luminance power source line 113 is cut-off. At this time, the diode 126 becomes forward-biased and turns ON, and the low-luminance power source voltage is supplied to the source of the P-type drive transistor 122.

As described above, in the circuit configuration illustrated in FIG. 17, the diode 126 is turned ON and OFF by turning the switching transistor 123 ON and OFF according to the control signal VELS.

Here, with regard to the control signal VELS, the scanning line drive circuit to which the scanning line 111 is connected determines the voltage level in the manner described below. For example, in the case where entire display grayscale is expressed by 256 levels, the control signal VELS is switched to the high level to select the high-luminance power source voltage when the grayscale signal value of the luminescence pixel 100A belongs to the high grayscale-side when the grayscale level 128 is assumed as a standard value, and the control signal VELS is switched to the low level to select the low-luminance power source voltage when the grayscale signal value belongs to the low grayscale-side.

According to the above-described configuration, the organic EL display device disclosed in Patent Reference 1 is provided with a high-luminance power source voltage and a low-luminance power source voltage, and controls switching of pixel voltage individually for each pixel circuit according to the control signal VELS, and, accordingly, has a circuit configuration that reliably prevents deterioration of picture quality and at the same time reduces power consumption.

SUMMARY OF THE INVENTION

However, in addition to the circuit configuration required for a normal pixel circuit, the organic EL display device disclosed in Patent Reference 1 requires, for each luminescence pixel, the selection transistor 121*a*, the holding capacitor element 124*a*, and the diode 126, as a power source voltage switching unit, in order to select the low power source voltage as the pixel power source to be used at the time of low grayscale level display. Furthermore, a control line for applying the control signal VELS to the gate of the switching transistor 123 needs to be provided separately from the scanning line drive circuit. Due to these circuit components and lines, the circuit size of the pixel circuit becomes big and thus becomes a disadvantage in terms of increasing the level of high-definition in the display panel.

Furthermore, the scanning line drive circuit needs to switch the voltage level of the control signal VELS for each luminescence pixel, and thus the load, on the scanning live drive circuit, when switching the voltage of the output signal from the drive circuit increases.

In view of the above described problems, the present invention has as an object to provide an organic EL display panel that realizes low power consumption through a simple pixel circuit configuration, without significantly increasing the number of elements of the pixel circuit even when luminescence pixel miniaturization and increases in the level of high-definition advance.

In order to achieve the aforementioned object, the organic EL display panel according to an aspect of the present invention includes: an organic EL element; a capacitor that includes a first electrode and a second electrode, and holds a voltage corresponding to a data voltage; a first drive transistor that is of a P-type and includes a gate electrode connected to the first electrode of the capacitor and a drain electrode connected to an anode electrode of the organic EL element, the first drive transistor causing the organic EL element to produce a luminescence by supplying the organic EL element with a first drain current corresponding to the voltage held by the capacitor; a second drive transistor that is of an N-type and includes a gate electrode connected to the first electrode of the capacitor and a source electrode connected to the anode of the organic EL element, the second drive transistor causing the organic EL element to produce the luminescence by supplying the organic EL element with a second drain current corresponding to the voltage held by the capacitor; a data line for supplying the data voltage; a switching transistor that causes the capacitor to hold the voltage, by switching between conduction and non-conduction between the data line and the capacitor; a first power source line for applying a first power source voltage to a source electrode of the first drive transistor; and a second power source line for applying, to a drain electrode of the second drive transistor, a second power source voltage which is higher than the first power source voltage, wherein the first drive transistor has current-voltage characteristics such that a first gate voltage value corresponding to a predetermined current value in current-voltage characteristics of the organic EL element is a minimum voltage of the data voltage, and that the lesser the first drain current is than the predetermined current value, the higher a gate voltage for causing the first drain current to flow becomes, and the second drive transistor has current-voltage characteristics such that a second gate voltage value corresponding to the predetermined current value is a voltage value greater than a third gate voltage value corresponding to a minimum value of a current that is caused to flow to the organic EL element, and that the greater the second drain current is than the predetermined current value, the higher a gate voltage for causing the second drain current to flow becomes.

Although the organic EL display panel and the method of driving the same according to the present invention requires two drive transistors for each luminescence pixel in order to lower power consumption, increasing the number of transistors by one allows the high-voltage power source line and the low-voltage power source line to be automatically selected according to the data voltage, without additionally providing a switching circuit for the high-voltage power source line and the low-voltage power source line and without providing two each of the data line and the selection transistor for every in accordance with the two drive transistors. As a result, an energy-saving pixel circuit can be realized with a simple configuration and without significantly increasing the circuit elements of the luminescence pixel.

FURTHER INFORMATION ABOUT TECHNICAL BACKGROUND TO THIS APPLICATION

The disclosure of PCT application No. PCT/JP2010/006597 filed on Nov. 10, 2010, including specification, drawings and claims is incorporated herein by reference in its entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENT

Figure 1:
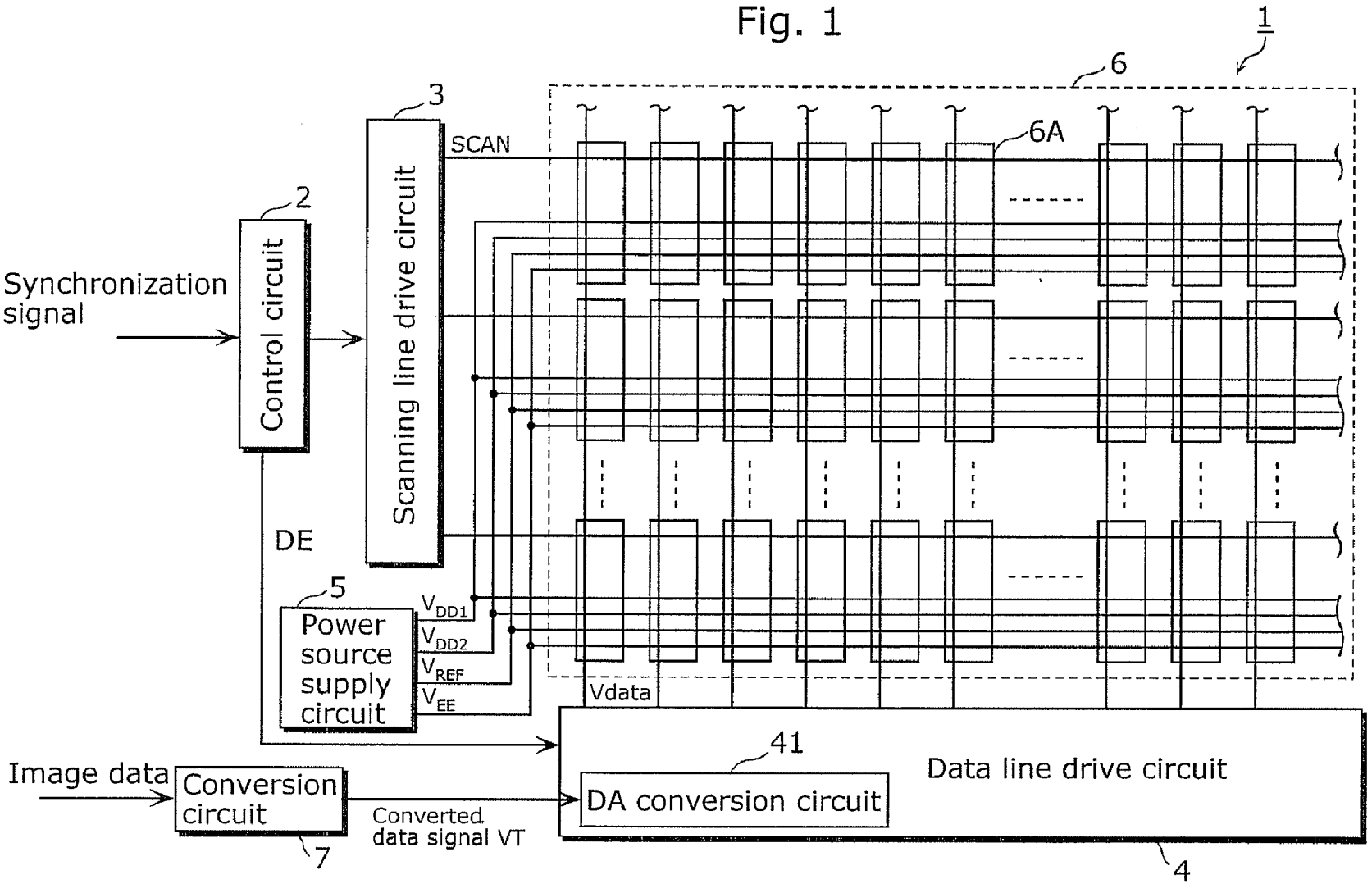
FIG. 1 is a function block diagram of an organic EL display panel according to an embodiment of the present invention.

In order to achieve the aforementioned object, the organic EL display panel according to an aspect of the present invention includes: an organic EL element; a capacitor that includes a first electrode and a second electrode, and holds a voltage corresponding to a data voltage; a first drive transistor that is of a P-type and includes a gate electrode connected to the first electrode of the capacitor and a drain electrode connected to an anode electrode of the organic EL element, the first drive transistor causing the organic EL element to produce a luminescence by supplying the organic EL element with a first drain current corresponding to the voltage held by the capacitor; a second drive transistor that is of an N-type and includes a gate electrode connected to the first electrode of the capacitor and a source electrode connected to the anode of the organic EL element, the second drive transistor causing the organic EL element to produce the luminescence by supplying the organic EL element with a second drain current corresponding to the voltage held by the capacitor; a data line for supplying the data voltage; a switching transistor that causes the capacitor to hold the voltage, by switching between conduction and non-conduction between the data line and the capacitor; a first power source line for applying a first power source voltage to a source electrode of the first drive transistor; and a second power source line for applying, to a drain electrode of the second drive transistor, a second power source voltage which is higher than the first power source voltage, wherein the first drive transistor has current-voltage characteristics such that a first gate voltage value corresponding to a predetermined current value in current-voltage characteristics of the organic EL element is a minimum voltage of the data voltage, and that the lesser the first drain current is than the predetermined current value, the higher a gate voltage for causing the first drain current to flow becomes, and the second drive transistor has current-voltage characteristics such that a second gate voltage value corresponding to the predetermined current value is a voltage value greater than a third gate voltage value corresponding to a minimum value of a current that is caused to flow to the organic EL element, and that the greater the second drain current is than the predetermined current value, the higher a gate voltage for causing the second drain current to flow becomes.

According to this aspect, two power source lines of different power source voltages are provided, and thus the first power source line and the second power source line are selectively used according to the data voltage. As such, instead of supplying the high power source voltage prepared as the maximum value for any data voltage, the high power source voltage is used only for a data voltage requiring high power source voltage in order to produce luminescence at an accurate luminance. As a result, power consumption can be significantly reduced compared to when high power source voltage is supplied for any data voltage.

Furthermore, according to this aspect, in providing two power source lines and selecting the first power source line and the second power source line according to the data voltage, the P-type first drive transistor and the N-type second drive transistor, which are drive transistors of mutually inversed polarities, are provided as drive transistors for driving the organic EL element. In addition, the first power source line is connected to the source electrode of the P-type first drive transistor, and the second power source line is connected to the drain electrode of the N-type second drive transistor.

On that basis, the first drive transistor is a transistor having current-voltage characteristics such that the gate voltage when a predetermined current value in the current-voltage characteristics of the organic EL element flows as the first drain current is a minimum voltage, and that the lesser the first drain current is than the predetermined current value, the higher the gate voltage value for causing the first drain current to flow becomes. On the other hand, the second drive transistor is a transistor having current-voltage characteristics such that the gate voltage value when the predetermined current value flows as the second drain current is a voltage value that is greater than the gate voltage value corresponding to the minimum value of a current flowing to the organic EL element, and that the greater the second drain current is than the predetermined current value, the higher the gate voltage value for causing the second drain current to flow becomes. It should be noted that the minimum value of the current that is caused to flow to the organic EL element is the current value when the threshold voltage is exceeded and forward current starts to flow in the organic EL element having diode characteristics.

Accordingly, although the number of drive transistors increases by one, increasing the number of drive transistors by one allows the first power source line and the second power source line to be selectively used according to the data voltage, without additionally providing a switching circuit for the first power source line and the second power source line and without providing a data line and a switching transistor for every two drive transistors. As a result, an energy-saving pixel circuit in which power consumption is lowered can be realized with a simple configuration and without significantly increasing the circuit elements of the luminescence pixel.

Furthermore, it is preferable that, in the organic EL display panel according to an aspect of the present invention, in the current-voltage characteristics of the first drive transistor, a fourth gate voltage value corresponding to a minimum value of a current that is caused to flow to the organic EL element be less than the third gate voltage value.

According to this aspect, the range of gate voltages for causing the first drain current of the P-type first drive transistor to flow and the range of gate voltages for causing the second drain current of the N-type second drive transistor to flow do not overlap and are completely separated With this, it becomes possible to cause the organic EL element to produce luminescence according to the drain current supplied from either one of the drive transistors only, for the entire range of data voltages, without additionally providing a switching circuit for the high-voltage power source line and the low-voltage power source line.

Furthermore, it is preferable that the organic EL display panel according to an aspect of the present invention further include: a conversion circuit that converts image data into a converted data signal; and a data line drive circuit that supplies the data voltage to the data line, and includes a digital-to-analog (DA) conversion circuit that converts, into the data voltage, the converted data signal inputted from the conversion circuit.

In this aspect, the data line drive circuit does not input a data voltage that directly corresponds to the image data, but supplies the data line with a data voltage obtained by digital-to-analog conversion of the converted data signal on which a predetermined conversion has been performed by the conversion circuit.

Furthermore, it is preferable that, in the organic EL display panel according to an aspect of the present invention, when the data voltage corresponding to the converted data signal is within a range that is from the first gate voltage value to the fourth gate voltage value in the current-voltage characteristics of the first drive transistor, the conversion circuit converts the image data into the converted data signal such that a data voltage after the conversion decreases as a display grayscale level of the image data corresponding to the range increases, and when the data voltage corresponding to the converted image data signal is within a range that is equal to or greater than the second gate voltage value in the current-voltage characteristics of the second drive transistor, the conversion circuit converts the image data into the converted data signal such that the data voltage after the conversion increases as the display grayscale level of the image data corresponding to the range increases.

According to this aspect, even when an organic EL element is driven using two drive transistors having mutually inverted polarities, data voltage corresponding to all regions, from the smallest value to the largest value of image data, can be generated according to the range of the data voltage corresponding to the converted data signal obtained by converting image data.

Accordingly, although the control for increasing and decreasing the converted data signal corresponding to the image data differs between the case where the data voltage corresponding to the converted data signal is in a range from the first gate voltage value corresponding to the predetermined current value to the fourth gate voltage value corresponding to a minimum value of a current that is caused to flow to the organic EL element, in the current-voltage characteristics of the first drive transistor, and the case where such data voltage is in the range that is equal to or greater than the second gate voltage value corresponding to the predetermined current value in the current-voltage characteristics of the second drive transistor, data voltage corresponding to all regions, from the smallest value to the largest value of image data, can be generated even when the organic EL element is driven using two drive transistors having mutually inverted polarities.

Furthermore, it is preferable that the organic EL display panel according to an aspect of the present invention further include a scanning line drive circuit that outputs, to the switching transistor via a scanning line, a scanning signal for controlling conduction and non-conduction of the switching transistor.

According to this aspect, the timing for supplying data voltage to the luminescence pixel is determined according to a scanning signal outputted from the scanning line drive circuit to the switching transistor via the scanning line.

Furthermore, in the organic EL display panel according to an aspect of the present invention, pixel circuits, each including the organic EL element, the capacitor, the first drive transistor, and the second drive transistor, may be arranged in a matrix.

With this, the first power source line and the second power source line can be selectively used according to the data voltage, by merely increasing the number of drive transistors in each of the pixel circuits by one. As a result, a display panel can be realized with a simple configuration, and without significantly increasing the circuit elements in terms of the whole display panel having luminescence pixels arranged in a matrix.

Furthermore, the organic EL display panel according to an aspect of the present invention may further include a control circuit that controls the data line drive circuit and the scanning line drive circuit, wherein the control circuit may control synchronizing of: a timing for turning ON of the switching transistor included in respective pixel circuits in one line of the matrix, through the scanning line drive circuit; and a timing for supplying of the data voltage to the respective pixel circuits in the one line of the matrix via the data line, through the data line drive circuit.

According to this aspect, the timing for supplying the data voltage from the data line drive circuit and the timing for supplying the scanning signal from the scanning line drive circuit are synchronized sequentially row-by-row. With this, the sequential row-by-row scanning of the panel luminescence production is realized.

Furthermore, in the organic EL display panel according to an aspect of the present invention, the data line drive circuit may supply, according to a synchronization signal from the control circuit, the respective pixel circuits in the one line of the matrix with the data voltage via the data line, in synchronization with a timing for outputting the scanning signal from the scanning line drive circuit to the respective pixel circuits in the one line.

According to this aspect, the data voltage after conversion can be outputted from the data line drive circuit in synchronization with the scanning signal, even when the conversion circuit is placed in a stage ahead of the data line drive circuit and the conversion tendency of the data voltage is changed according to the image signal.

Furthermore, the present invention can be implemented, not only as an organic EL display panel including such characteristic units, but also as an organic EL display device including the organic EL display panel.

Furthermore, the present invention can be implemented, not only as an organic EL display panel including such characteristic units, but also as a driving method of organic EL display panel having, as steps, such characteristic units included in the organic EL display panel.

Furthermore, the organic EL display panel according to an aspect of the present invention may include: an organic EL element; a capacitor that includes a first electrode and a second electrode, and holds a voltage corresponding to a data voltage; a first drive transistor that is of an N-type and includes a gate electrode connected to the first electrode of the capacitor and a drain electrode connected to a cathode of the organic EL element, the first drive transistor causing the organic EL element to produce a luminescence by supplying the organic EL element with a first drain current corresponding to the voltage held by the capacitor; a second drive transistor that is of a P-type and includes a gate electrode connected to the first electrode of the capacitor and a source electrode connected to the cathode of the organic EL element, the second drive transistor causing the organic EL element to produce the luminescence by supplying the organic EL element with a second drain current corresponding to the voltage held by the capacitor; a data line for supplying the data voltage; a switching transistor that causes the capacitor to hold the voltage, by switching between conduction and non-conduction between the data line and the capacitor; a first power source line for applying a first power source voltage to a source electrode of the first drive transistor; and a second power source line for applying, to a drain electrode of the second drive transistor, a second power source voltage which is higher than the first power source voltage, wherein the first drive transistor may have current-voltage characteristics such that a first gate voltage value corresponding to a predetermined current value in current-voltage characteristics of the organic EL element is a maximum value of the data voltage, and that the lesser the first drain current is than the predetermined current value, the lower a gate voltage for causing the first drain current to flow becomes, and the second drive transistor may have current-voltage characteristics such that a second gate voltage value corresponding to the predetermined current value is a voltage value greater than a third gate voltage value corresponding to a minimum value of a current that is caused to flow to the organic EL element, and that the greater the second drain current is than the predetermined current value, the lower a gate voltage for causing the second drain current to flow becomes.

According to this aspect, the same advantageous effect as in an organic EL display panel having a circuit configuration in which a drive transistor is connected to the anode-side of the organic EL element is produced even in a circuit configuration in which a drive transistor is connected to the cathode-side of the organic EL element.

Embodiment

Hereinafter, embodiments of the present invention shall be described with reference to the Drawings.

FIG. 1 is a function block diagram of an organic EL display panel according to an embodiment of the present invention. An organic EL display panel 1 in the figure includes a control circuit 2, a scanning line drive circuit 3, a data line drive circuit 4, a power source supply circuit 5, a display unit 6, and a conversion circuit 7.

The display unit 6 includes luminescence pixels 6A which are arranged in a matrix. Data voltage Vdata is supplied to the luminescence pixels 6A via a data line provided on a luminescence pixel column basis. A scanning signal SCAN is supplied to the luminescence pixels 6A via a scanning line provided on a luminescence pixel row basis.

The scanning line drive circuit 3 drives the circuit element of each luminescence pixel 6A by outputting the scanning signal SCAN sequentially on a row-by-row basis to the respective scanning lines provided on a row basis. The scanning signal SCAN is a signal for switching between the conduction and non-conduction of the switching transistor of each luminescence pixel 6A. Specifically, the scanning line drive circuit 3 supplies the scanning signal SCAN to the luminescence pixel 6A according to the input of a start pulse signal from the control circuit 2.

The data line drive circuit 4 drives the circuit element of a luminescence pixel by outputting a data voltage that is based on an image signal, to the data line which is provided on a column basis. Specifically, the data line drive circuit 4 supplies the data voltage to the luminescence pixels 6A in synchronization with the row-by-row sequential output of the scanning signal from the scanning line drive circuit 3 to the luminescence pixels 6A, according to the input of a synchronization signal from the control circuit 2. Furthermore, the data line drive circuit 4 includes a DA (digital-to-analog) conversion circuit which converts a converted data signal which is a digital signal inputted from the conversion circuit 7, into a data voltage which is an analog signal.

The control circuit 2 controls the output timing of the scanning signal SCAN outputted from the scanning line drive circuit 3. Furthermore, the control circuit 2 controls the output timing of the data voltage outputted from the data line drive circuit 4. Specifically, the control circuit 2 controls the timing for switching the switching transistor of a luminescence pixel 6A to the conductive state, by outputting the start pulse signal to the scanning line drive circuit 3 according to an image signal that is inputted from an external source. Furthermore, the control circuit 2 performs the control for synchronizing the timing for supplying the data voltage outputted from the data line drive circuit 4 and the output timing for the scanning signal SCAN, by outputting a synchronization signal to the data line drive circuit 4.

The power source supply circuit 5 supplies a fixed power source voltage to all of the luminescence pixels 6A via the respective power source lines.

The conversion circuit 7 converts, into a converted data signal, image data which is luminance information of an image signal inputted from an outside source. The specific conversion method shall be described later using FIG. 6.

Figure 2:
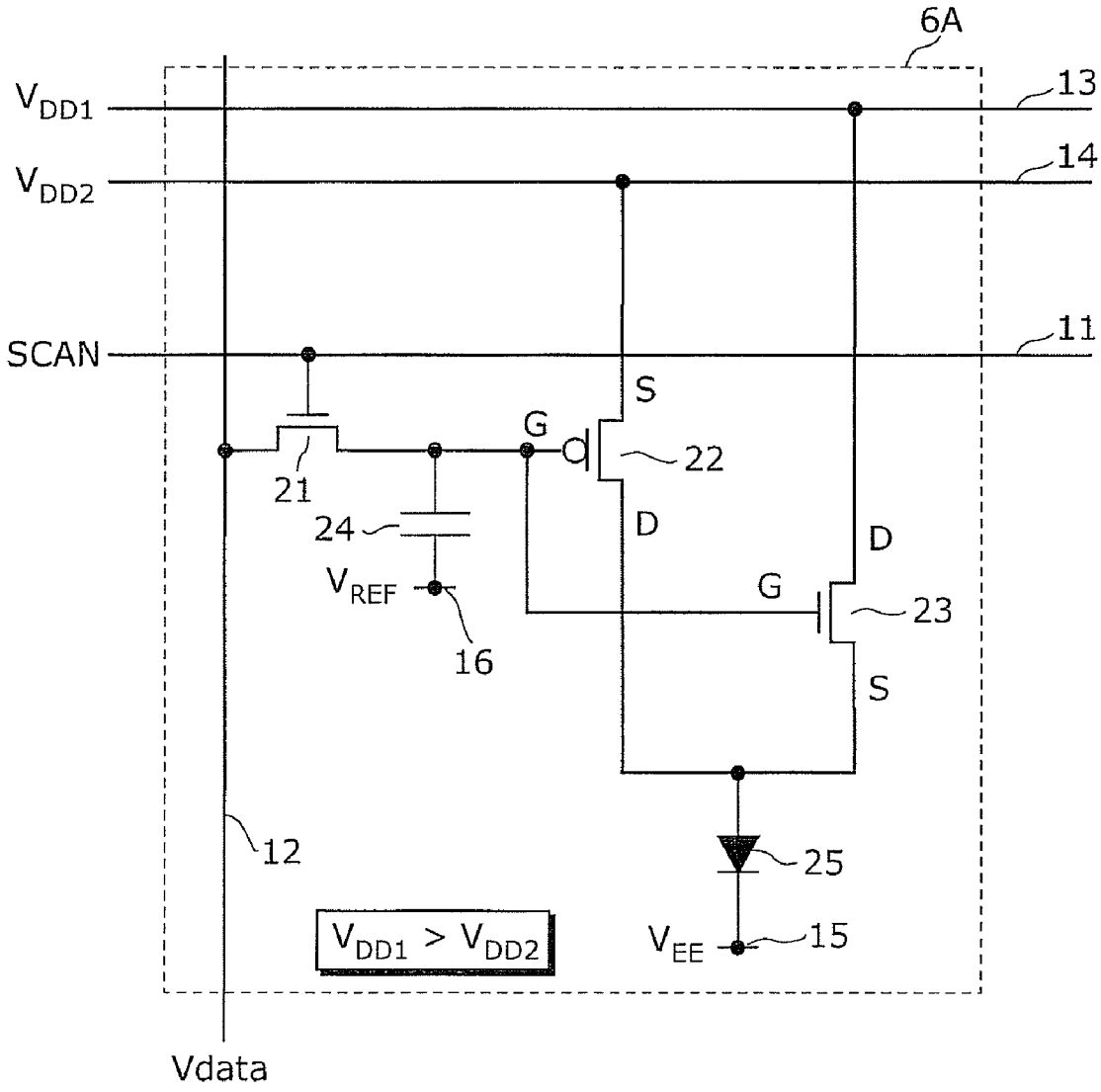
FIG. 2 is a circuit diagram of a luminescence pixel according to the embodiment of the present invention.

FIG. 2 is a circuit diagram of a luminescence pixel according to the embodiment of the present invention. The luminescence pixel 6A illustrated in the figure includes a selection transistor 21, a P-type drive transistor 22, an N-type drive transistor 23, a capacitor 24, and an organic EL element 25. Furthermore, a data line 12 is provided on a luminescence pixel column basis, and a scanning line 11 is provided on a luminescence pixel row basis. In addition, a first power source line 14, a second power source line 13, a standard power source line 15, and a reference power source line 16 are provided to all the luminescence pixels 6A. Furthermore, each of the first power source line 14, the second power source line 13, the standard power source line 15, and the reference power source line 16 is also connected to the other luminescence pixels, and to the power source supply circuit 5. Furthermore, a high voltage $V_{DD1}$ that is set to the second power source line 13 is set higher than a low voltage $V_{DD2}$ that is set to the first power source line 14, and both the first power source line 14 and the second power source line 13 are set to a higher potential than the standard power source line 15.

The data line 12 is connected to the data line drive circuit 4, and is connected to the respective luminescence pixels belonging to the pixel column that includes the luminescence pixel 6A. With this, the data voltage Vdata which determines luminescence intensity is supplied to the luminescence pixel 6A via the data line 12.

The scanning line 11 is connected to the scanning line drive circuit 3, and is connected to the respective luminescence pixels belonging to the pixel row that includes the luminescence pixel 6A. With this, the scanning signal SCAN indicating the timing for writing the data voltage Vdata is supplied to the luminescence pixel 6A via the scanning line 11.

The selection transistor 21 is a switching transistor having gate electrode connected to the scanning line 11, and one of a source electrode and a drain electrode connected to the respective gate electrodes of the P-type drive transistor 22 and the N-type drive transistor 23. The selection transistor 21, in accordance with the scanning signal SCAN from the scanning line 11, causes the capacitor to hold a voltage corresponding to the data voltage by switching between conduction and non-conduction between the data line 12 and the condenser 24. The selection transistor 21 is configured of, for example, an N-type thin film transistor (N-type TFT).

The P-type drive transistor 22 has a gate electrode connected to a first electrode of the capacitor 24, a drain electrode connected to the anode of the organic EL element 25, and a source electrode connected to the first power source line 14. With the above-described connection relationship, the P-type drive transistor 22 causes the organic EL element 25 to produce luminescence by supplying the organic EL element 25 with a first drain current corresponding to the voltage held by the capacitor 24. The P-type drive transistor 22 is configured of, for example, a P-type thin film transistor (P-type TFT). Here, the first drain current is a current that flows from the first power source line 14 to the standard power source line 15 via the P-type drive transistor 22.

The N-type drive transistor 23 has a gate electrode connected to the first electrode of the capacitor 24, a source electrode connected to the anode of the organic EL element 25, and a drain electrode connected to the second power source line 13. With the above-described connection relationship, the N-type drive transistor 23 causes the organic EL element 25 to produce luminescence by supplying the organic EL element 25 with a second drain current corresponding to the voltage held by the capacitor 24. The N-type drive transistor 23 is configured of, for example, an N-type thin film transistor (N-type TFT). Here, the second drain current is a current that flows from the second power source line 13 to the standard power source line 15 via the N-type drive transistor 23.

The organic EL element 25 is a luminescence element having an anode connected to the drain electrode of the P-type drive transistor 22 and the source electrode of the N-type drive transistor 23, and a cathode connected to the standard power source line 15. With the above-described connection relationship, the organic EL element 25 produces luminescence according to the flow of the first drain current of the P-type drive transistor 22 or the second drain current of the N-type drive transistor 23.

The capacitor 24, whose first electrode is connected to the respective gates of the P-type drive transistor 22 and the N-type drive transistor 23 and whose second electrode is connected to the reference power source line 16, holds a voltage that corresponds to the data voltage. For example, the capacitor 24 has a function of stably holding the gate-source voltage of the P-type drive transistor 22 and the N-type drive transistor 23 after the selection transistor 21 turns OFF, and thus stabilizing the first and second drain currents.

Here, the first drain current supplied by the P-type drive transistor 22 and the second drain current supplied by the N-type drive transistor 23 are selectively set to flow to the organic EL element 25, with a predetermined current value in the current-voltage characteristics of the organic EL element 25 as a threshold value. Specifically, by having one of the first drain current and the second drain current flow to the organic EL element 25 in each display grayscale level, either one of the drain currents becomes the luminescence current of the organic EL element 25. In the luminescence pixel 6A, in the low luminescence current region for example, the P-type drive transistor 22 turns ON, thus causing the first drain current to flow as the luminescence current. Furthermore, in the high luminescence current region, the N-type drive transistor 23 turns ON, thus causing the second drain current to flow as the luminescence current. As such, in the low luminescence current region, the first drain current flows, to the organic EL element 25, from the first power source line 14 to which the low voltage $V_{DD2}$ is set. Therefore, in the luminescence production operation in the low luminescence current region, it becomes possible to lower power consumption compared to when drain current is caused to flow from the second power source line 13.

More specifically, although the number of drive transistors increases by one compared to a normal luminescence pixel circuit, in the luminescence pixels 6A according to the embodiment of the present invention, increasing the number of drive transistors by one allows the first power source line 14 and the second power source line 13 to be selectively used according to the data voltage, without additionally providing a switching circuit for the first power source line 14 and the second power source line 13 and without providing a data line and a selection transistor for every two drive transistors. As a result, an energy-saving pixel circuit in which power consumption is lowered can be realized with a simple configuration and without significantly increasing the circuit elements of the luminescence pixel.

Hereinafter, a configuration for implementing the selection between the first drain current and the second drain current according to the display grayscale level without additionally providing a switching circuit for the first power source line 14 and the second power source line 13, in the organic EL display panel 1 according to the present invention shall be described.

Figure 3:
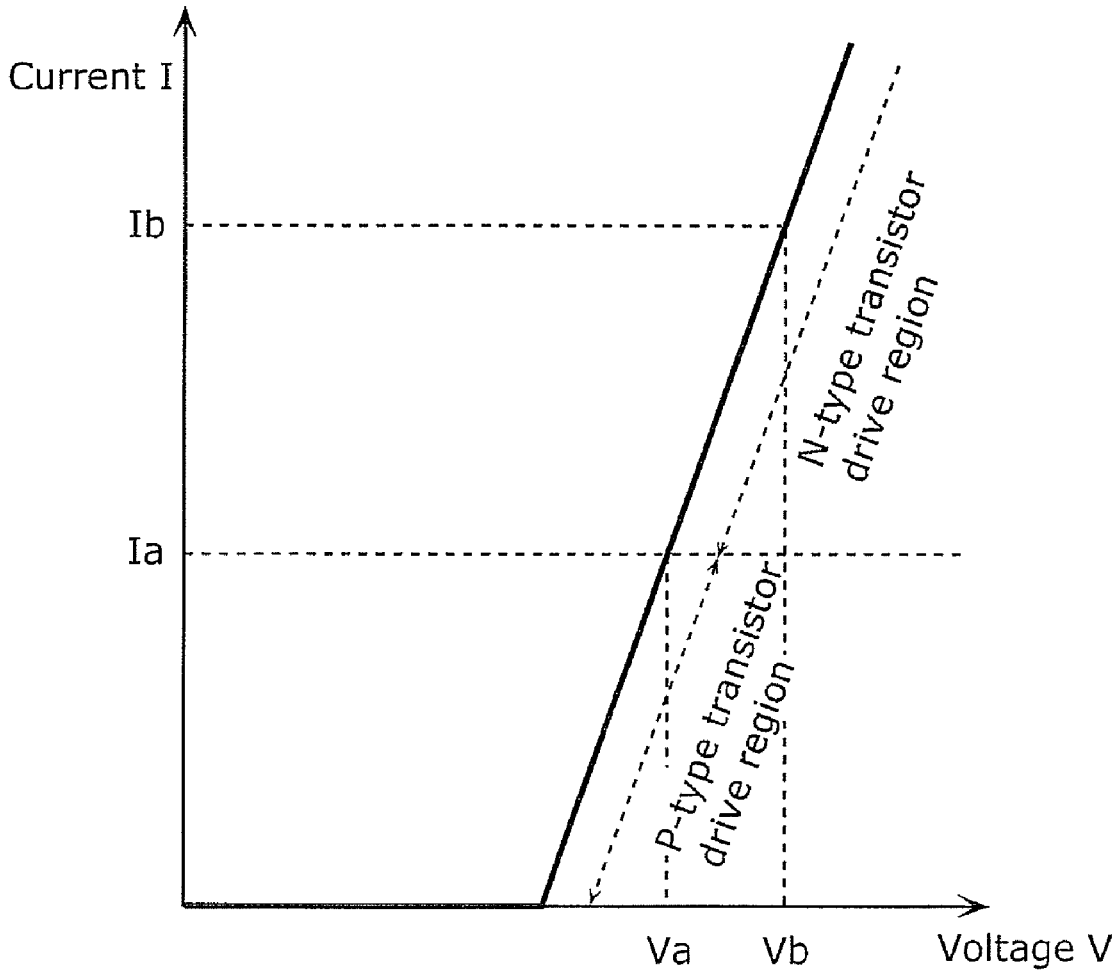
FIG. 3 is a graph schematically representing current-voltage characteristics of the organic EL element.

FIG. 3 is a graph schematically representing the current-voltage characteristics of the organic EL element. In the figure, the horizontal axis represents the applied voltage between the anode and cathode of the organic EL element, and the vertical axis represents the forward current. As shown in the figure, the current-voltage characteristics of the organic EL element 25 become diode characteristics. Forward current starts to flow when a voltage equal to or greater than the predetermined threshold is applied between the anode and cathode, and current monotonically increases with the increase in voltage.

Here, in the organic EL display panel 1 according to the embodiment of the present invention, a predetermined current value Ia is defined in the current-voltage characteristics of the organic EL element 25. Thus, with the current Ia with which the organic EL element 25 produces luminescence serving as a boundary current, luminescence current is caused to flow to the organic EL element 25 via the second power source line 13 and the N-type drive transistor 23 which supply high-voltage power source voltage, in a current region that is greater than Ia. Moreover, in a current region that is equal to or less than Ia, the luminescence current is caused to flow to the organic EL element 25 via the first power source line 14 and the P-type drive transistor 22 which supply low-voltage power source voltage.

Next, the current-voltage characteristics of the P-type drive transistor 22 and the N-type drive transistor 23 for causing one of the first drain current and the second drain current to flow to the organic EL element 25, with Ia as a threshold value, shall be described.

Figure 4:
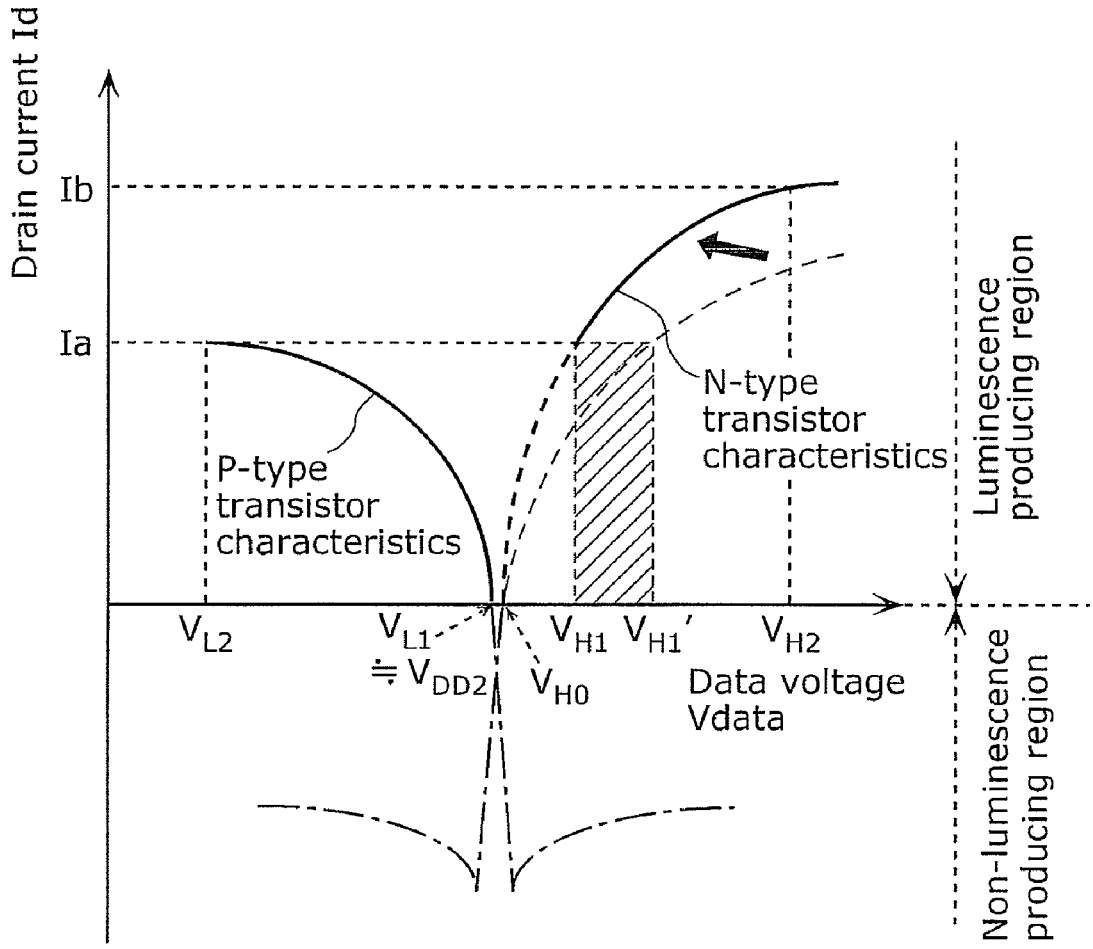
FIG. 4 is a graph representing current-voltage characteristics of two drive transistors according to the embodiment of the present invention.

FIG. 4 is a graph representing current-voltage characteristics of the two drive transistors according to the embodiment of the present invention. In the figure, the horizontal axis represents the data voltage Vdata, that is, the voltage applied to the gate electrode of the drive transistor, and the vertical axis represents a drain current Id of the drive transistor. Furthermore, a first gate voltage value is $V_{L2}$, a second gate voltage value is $V_{H1}$, a third gate voltage value is $V_{H0}$, and a fourth gate voltage value is $V_{L1}$.

The P-type drive transistor 22 has current-voltage characteristics such that the first gate voltage value $V_{L2}$ when the current Ia in the current-voltage characteristics of the organic EL element 25 shown in FIG. 3 is caused to flow as the first drain current is a minimum voltage in a range of data voltages for expressing display grayscale levels, and that the lesser the first drain current is than the current Ia, the higher the gate voltage for causing the first drain current to flow becomes. Stated differently, the P-type drive transistor 22 has current-voltage characteristics such that the first drain current decreases as the gate voltage increases.

On the other hand, the N-type drive transistor 23 has current-voltage characteristics such that the second gate voltage value $V_{H1}$ when the current Ia is caused to flow as the second drain current is a voltage value that is greater than the third gate voltage value $V_{H0}$ corresponding to a minimum current value Imin that is caused to flow to the organic EL element 25, and that the greater the second drain current is than the current Ia, the higher the gate voltage for causing the second drain current to flow becomes. Stated differently, the N-type drive transistor 23 has current-voltage characteristics such that the second drain current increases as the gate voltage increases. Furthermore, the N-type drive transistor 23 causes a current Ib to flow as the second drain current when the gate voltage value is $V_{H2}$. Here, the current value Imin is a current value on the horizontal axis in the current-voltage characteristics shown in FIG. 4, and, in terms of being a luminescence current, those currents that are less than the current value Imin can be disregarded.

It should be noted that it is preferable that the fourth gate voltage value $V_{L1}$ corresponding to the minimum current Imin that is caused to flow to the organic EL element in the current-voltage characteristics of the P-type drive transistor 22 be set lower than the third gate voltage value $V_{H0}$.

With this, the range of gate voltages for causing the first drain current of the P-type drive transistor 22 to flow and the range of gate voltages for causing the second drain current of the N-type drive transistor 23 to flow do not overlap and are completely separated. With this, it becomes possible to cause the organic EL element 25 to produce luminescence according to the drain current supplied from either one of the drive transistors only, for entire range of data voltages, without additionally providing a switching circuit for the high-voltage power source line and the low-voltage power source line.

Furthermore, it is preferable that the potential difference between the second gate voltage value $V_{H1}$ and the third gate voltage value $V_{H0}$ of the N-type drive transistor 23 be less than the potential difference between the fourth gate voltage value $V_{L1}$ and the first gate voltage value $V_{L2}$ of the P-type drive transistor 22. In addition, it is preferable that the potential difference between the second gate voltage value $V_{H1}$ and the third gate voltage value $V_{H0}$ of the N-type drive transistor 23 be as small as possible.

With regard to the drain current to be supplied to the organic EL element 25, the application of a gate voltage corresponding to the fourth gate voltage value $V_{L1}$ to the gate electrode of the P-type drive transistor 22 causes the first drain current to start flowing, and the gate voltage decreases up to the first gate voltage value $V_{L2}$ as the first drain current increases. Then, when the first drain value becomes the predetermined current value Ia, the application of a voltage corresponding to the second gate voltage value $V_{H1}$ to the gate electrode of the N-type drive transistor 23 causes the second drain current to start flowing. In other words, the voltage range in which both the P-type drive transistor 22 and the N-type drive transistor 23 do not cause current to flow is the voltage range corresponding to the interval between the fourth gate voltage value $V_{L1}$ and the second gate voltage value $V_{H1}$. By reducing this range, that is, steepening the slope of the current-voltage characteristics of the N-type drive transistor 23 in such range allows the second gate voltage value $V_{H1}$ to be set to the low voltage-side (from $V_{H1}'$ to $V_{H1}$) as much as possible, and thus the voltage for causing the second drain current flowing to the second drive transistor to flow can be reduced and power consumption can be reduced.

Furthermore, it is preferable that the potential difference between the fourth gate voltage value $V_{L1}$ and the first gate voltage value $V_{L2}$ of the P-type drive transistor 22 be greater than the potential difference between the second gate voltage value $V_{H1}$ and the third gate voltage value $V_{H0}$ of the N-type drive transistor 23. By making the potential difference between the fourth gate voltage value $V_{L1}$ and the first gate voltage value $V_{L2}$ of the P-type drive transistor 22 greater than the potential difference between the second gate voltage value $V_{H1}$ and the third gate voltage value $V_{H0}$ of the N-type drive transistor 23, the number of displayable grayscale levels in the low grayscale region can be increased. The reason for this is described below.

The data voltage to be applied to the respective gate electrodes of the P-type drive transistor 22 and the N-type drive transistor 23 are applied with a predetermined minimum resolution. For example, when 0.01 V is assumed as the minimum resolution, data voltage can be inputted in 0.01-V units. In view of this, for example, a case is assumed where the potential difference between the second gate voltage value $V_{H1}$ and the third gate voltage value $V_{H0}$ of the N-type drive transistor 23 is set as 0.5 V and the potential difference between the fourth gate voltage value $V_{L1}$ and the first gate voltage value $V_{L2}$ of the P-type drive transistor 22 is set as 1 V. In this case, in the interval of the potential difference between the second gate voltage value $V_{H1}$ and the third gate voltage value $V_{H0}$ of the N-type drive transistor 23, 50 grayscale levels can be allocated in the drain current range equal to or less than Ia, whereas, in the interval of the potential difference between the fourth gate voltage value $V_{L1}$ and the first gate voltage value $V_{L2}$ of the P-type drive transistor 22, 100 grayscale levels can be allocated in the same drain current range. In the organic EL display panel 1 according to the embodiment, at the predetermined current value Ia and below, the first drain current flowing to the P-type drive transistor 22 flows to the organic EL element 25. Therefore, controlling the current in the low grayscale region is performed, not according to the number of grayscale levels for the N-type drive transistor 23, but according to the number of grayscale levels for the P-type drive transistor 22. With this, it is possible to set a large number of grayscale levels in the drain current range equal to or less than the predetermined current value Ia, and thus the grayscale levels for which output is possible in the low grayscale region of the organic EL element 25 also increases. In particular, since human eyes are sensitive to the luminance in the low grayscale region, the increase in the displayable grayscale levels in the low grayscale region allows the quality of displayable colors of the display device to be improved.

Next, the voltage in the current-voltage characteristics of the P-type drive transistor 22 and the N-type drive transistor 23 described above shall be expressed using the gate-source voltage.

Figure 5A:
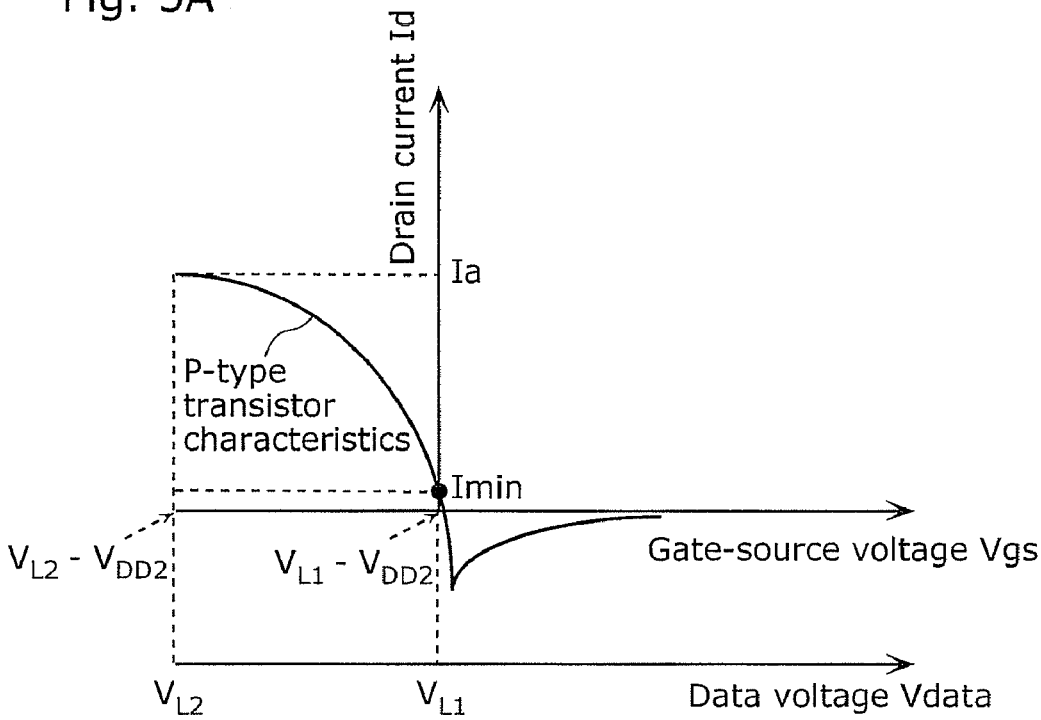
FIG. 5A is a graph representing current-voltage characteristics of a P-type drive transistor according to the embodiment of the present invention.

FIG. 5A is a graph representing the current-voltage characteristics of P-type drive transistor 22 according to the embodiment of the present invention. With respect to the value of the gate voltage applied to the gate electrode of the P-type drive transistor 22, the gate-source voltage Vgs is a value obtained by subtracting, from the gate voltage value, $V_{DD2}$ which is the voltage of the source electrode. Therefore, the range of the data voltages for causing the first drain current of the P-type drive transistor 22 to flow and the range of Vgs can be set to be the same ($V_{L1}$ to $V_{L2}$).

Figure 5B:
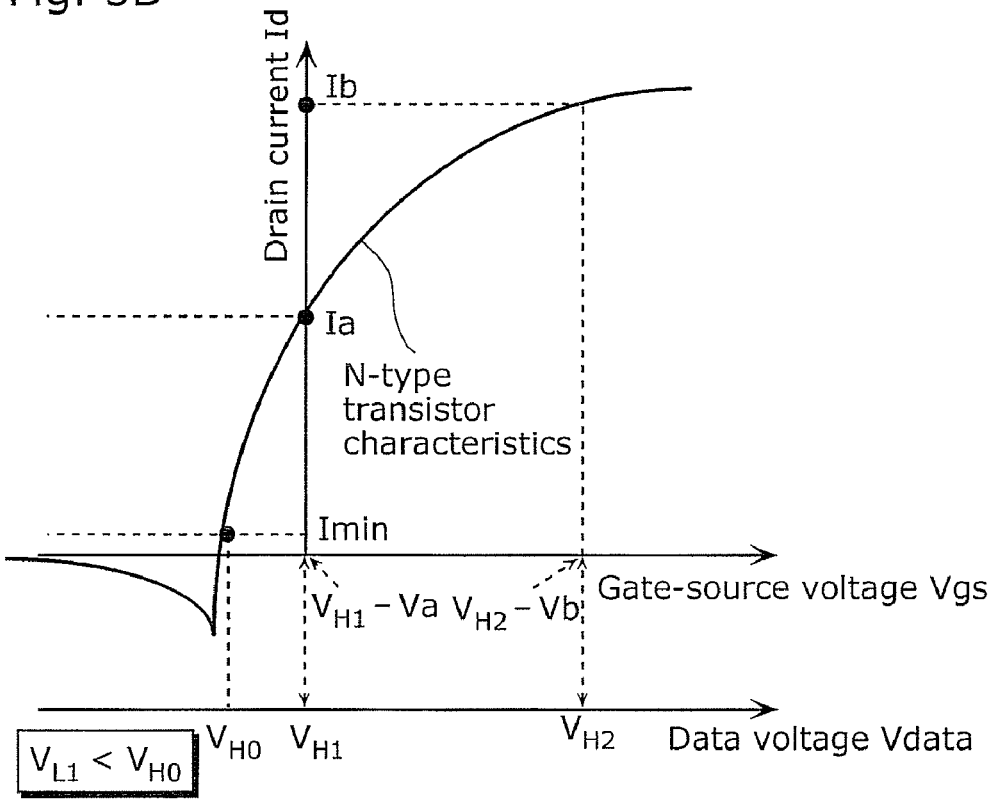
FIG. 5B is a graph representing current-voltage characteristics of an N-type drive transistor according to the embodiment of the present invention.

As described above, according to the drive transistor characteristics illustrated in FIG. 4, FIG. 5A, and FIG. 5B, setting $V_{L1}$ to $V_{L2}$ as the range of data voltages for causing the first drain current of the P-type drive transistor 22 to flow to the organic EL element 25 and setting $V_{H1}$ to $V_{H2}$ as the range of data voltages for causing the second drain current of the N-type drive transistor 23 to flow to the organic EL element 25 makes it possible to selectively cause the first drain current of the P-type drive transistor 22 to flow as the luminescence current of the organic EL element 25 when the drain current is in a range equal to or less than Ia, and cause the second drain current of the N-type drive transistor 23 to flow as the luminescence current of the organic EL element 25 when the drain current is in a range that is greater than Ia.

Next, the function of the conversion circuit 7 for sequentially causing luminescence current of the organic EL element 25 to flow according to the display grayscale level, in accordance with $V_{L1}$ to $V_{L2}$ and $V_{H1}$ to $V_{H2}$ which are the above described data voltage ranges, shall be described. The conversion circuit 7 converts, into a converted data signal VT, image data inputted from an outside source.

Figure 6:
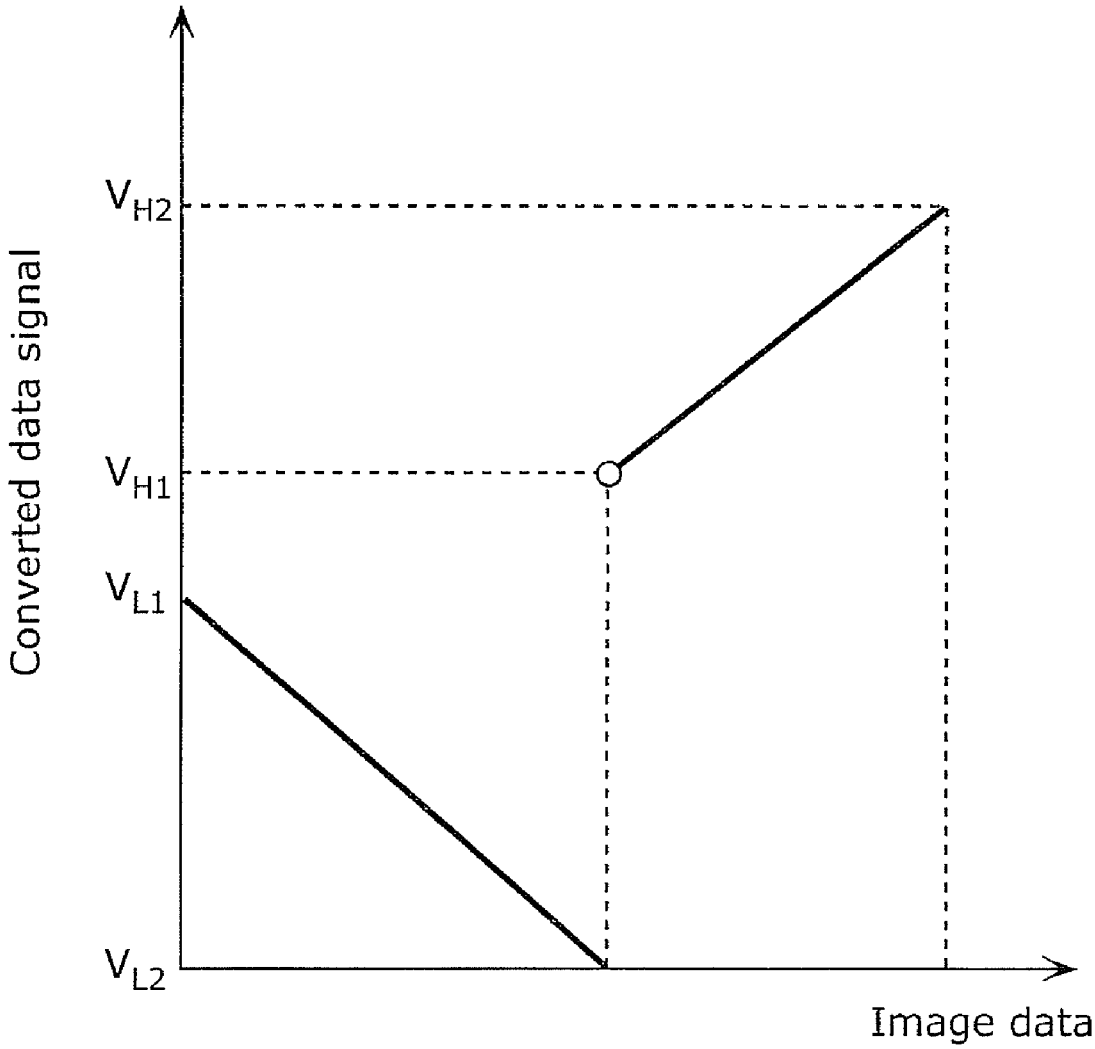
FIG. 6 is a graph representing conversion characteristics of a conversion circuit according to the embodiment of the present invention.

FIG. 6 is a graph representing conversion characteristics of a conversion circuit according to the embodiment of the present invention. In the graph shown in the figure, the horizontal axis represents image data inputted to the conversion circuit 7, and the vertical axis represents the converted data signal VT outputted from the conversion circuit 7. The image data is, for example, digital data for expressing the luminance of 256 grayscale levels (0 to 255). The conversion characteristics in the graph are such that, when the display grayscale level is from a low grayscale level (0) up to a predetermined intermediate grayscale level (for example, grayscale level 127), VT monotonically decreases within the range of $V_{L1}$ to $V_{L2}$ following an increase in the display grayscale level. On the other hand, when the display grayscale level is from a predetermined intermediate grayscale level (for example, gray scale level 128) up to a high grayscale level, VT monotonically increases within the range of $V_{H1}$ to $V_{H2}$ following an increase in the display grayscale level.

Furthermore, VT outputted from the conversion circuit 7 is inputted to a digital-to-analog (DA) conversion circuit 41 of the data line drive circuit 4, and is converted into a data voltage which is an analog signal. In this embodiment, the data line drive circuit 4 does not output a data voltage that directly corresponds to the image data, but supplies, to the data line, a data voltage obtained by performing digital-to-analog conversion on the converted data signal on which a predetermined conversion has been performed by the conversion circuit 7.

Specifically, when the data voltage corresponding to the converted data signal VT is within the range of $V_{L2}$ to $V_{L1}$ in the current-voltage characteristics of the P-type drive transistor 22, the conversion circuit 7 converts from image data to the converted data signal VT such that the data voltage becomes lower as the display grayscale level of the image data corresponding to such range becomes higher. On the other hand, when the data voltage corresponding to the converted data signal VT is in the range that is greater than $V_{H1}$ in the current-voltage characteristics of the N-type drive transistor 23, the conversion circuit 7 converts from image data to the converted data signal VT such that the data voltage becomes higher as the display grayscale level of the image data corresponding to such range becomes higher.

The organic EL display panel 1 stores, for example in an internal memory, a table of the above-described conversion characteristics. The conversion circuit 7 reads the table of conversion characteristics from the aforementioned memory, and converts image data into a converted data signal according to the table.

According to this aspect, even when an organic EL element is driven using two drive transistors having mutually inverted polarities, data voltages corresponding to all regions, from the smallest value to the largest value of image data, can be generated according to the range of the data voltage corresponding to the converted data signal obtained by converting the image data.

Accordingly, although the control for increasing and decreasing the converted data signal corresponding to the image data differs between the case where the data voltage corresponding to the converted data signal VT is in the range of $V_{L2}$ to $V_{L1}$ in the current-voltage characteristics of the P-type drive transistor 22, and the case where such data voltage is in the range that is greater than $V_{H1}$ in the current-voltage characteristics of the N-type drive transistor 23, data voltages corresponding to all regions, from the smallest value to the largest value of image data, can be generated even when the organic EL element 25 is driven using two drive transistors having mutually inverted polarities.

The flow of an organic EL display panel driving method, from when the image signal is inputted to the organic EL display panel according to the present invention up to when the organic EL display panel performs the display operation, as well as the various signals, shall be subsequently described.

Figure 7A:
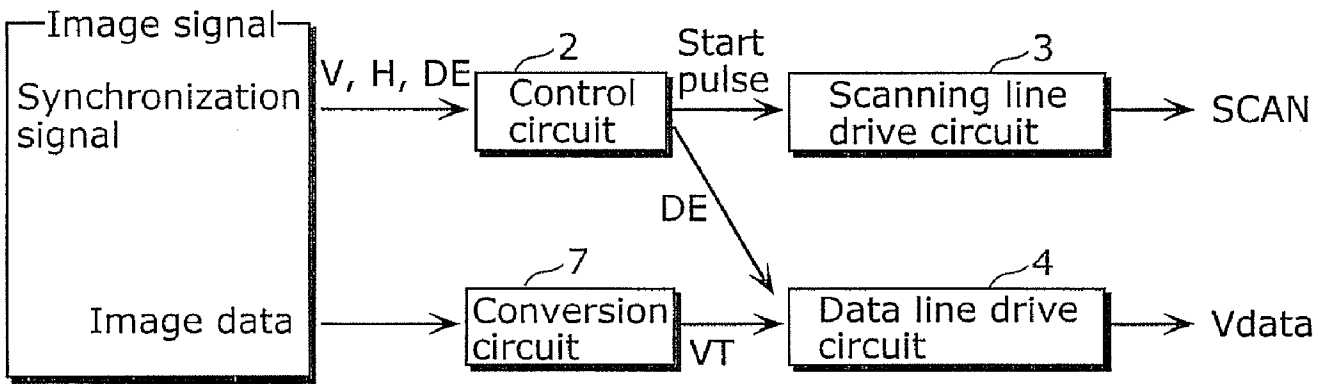
FIG. 7A is a diagram representing the flow of various signals in the organic EL display panel according to the embodiment of the present invention.

FIG. 7A is a diagram representing the flow of various signals in the organic EL display panel according to the embodiment of the present invention. The image signal is composed of a synchronization signal and image data.

The synchronization signal includes a vertical synchronization signal V, a horizontal synchronization signal H, and a DE (Display Enable) signal, and such synchronization signals are inputted to the control circuit 2. Upon receiving the aforementioned synchronization signals, the control circuit 2 controls the output timing of the scanning signal SCAN, which is outputted from the scanning line drive circuit 3, by outputting a start pulse signal to the scanning line drive circuit 3, and controls the synchronization of the timing for supplying the data voltage outputted from the data line drive circuit 4 and the output timing of the scanning signal SCAN by outputting the synchronization signal to the data line drive circuit 4.

The image data is a digital luminance information signal for causing the organic EL element 25 of the respective luminescence pixels 6A to produce luminescence, and is inputted to the conversion circuit 7. As shown in FIG. 6, the conversion circuit 7 converts the image data into the converted data signal VT, and outputs the converted data signal VT to the data line drive circuit 4. The data line drive circuit 4 converts the digital converted data signal VT to an analog data voltage using the built-in DA conversion circuit 41, and outputs the data voltage to a luminescence pixel 6A.

Figure 7B:
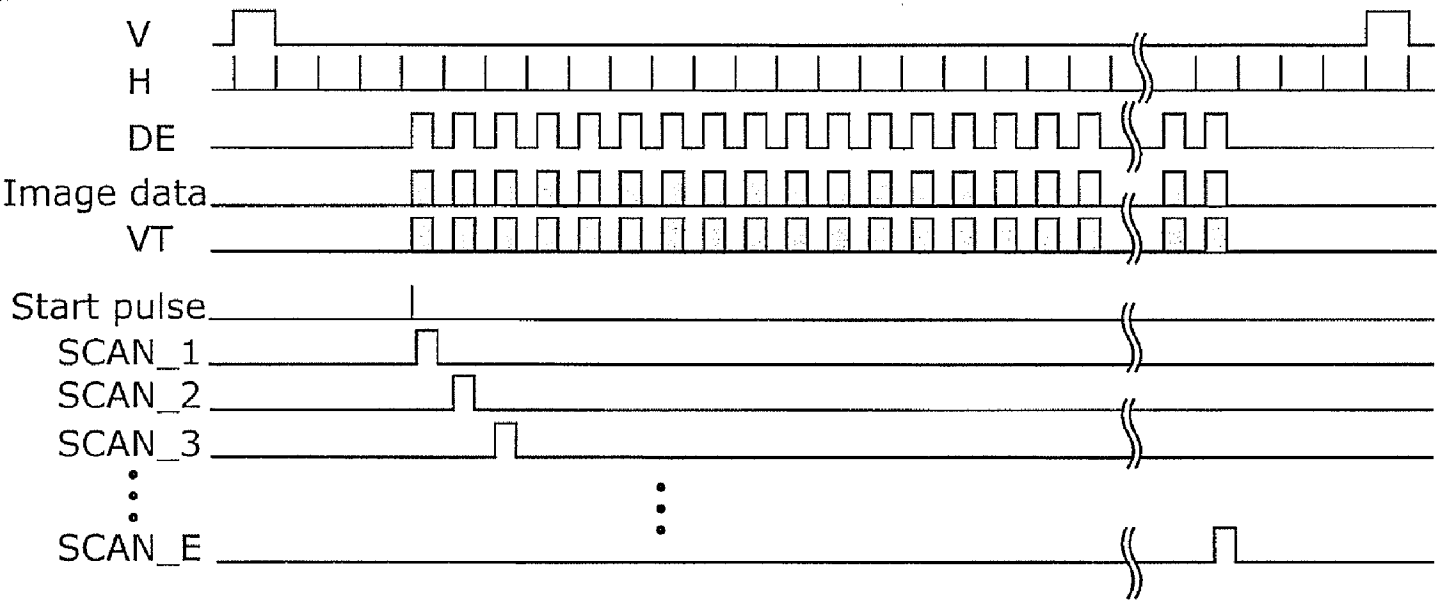
FIG. 7B is a drive timing chart of the organic EL display panel according to the embodiment of the present invention.

FIG. 7B is a drive timing chart of the organic EL display panel according to the embodiment of the present invention. In the figure, the following signals are displayed in chronological order, from top to bottom: the vertical synchronization signal V, the horizontal synchronization signal H, the DE signal, the image data, the converted data signal VT, the start pulse signal, a first row scanning signal SCAN_1, a second row scanning signal SCAN_2, a third row scanning signal SCAN_3, and a last row scanning signal SCAN_E.

First, the writing timing for one frame is determined according to the vertical synchronization signal V, and the timing for writing into each luminescence pixel row is determined according to the horizontal synchronization signal H.

Next, the scanning signal SCAN switches sequentially row-by-row to the high level according to the start pulse signal, and a data voltage resulting from the conversion of the converted data signal VT is outputted to the data line in synchronization with the DE signal.

Hereinafter, the organic EL display panel driving method according to the embodiment of the present invention shall be described.

Figure 8:
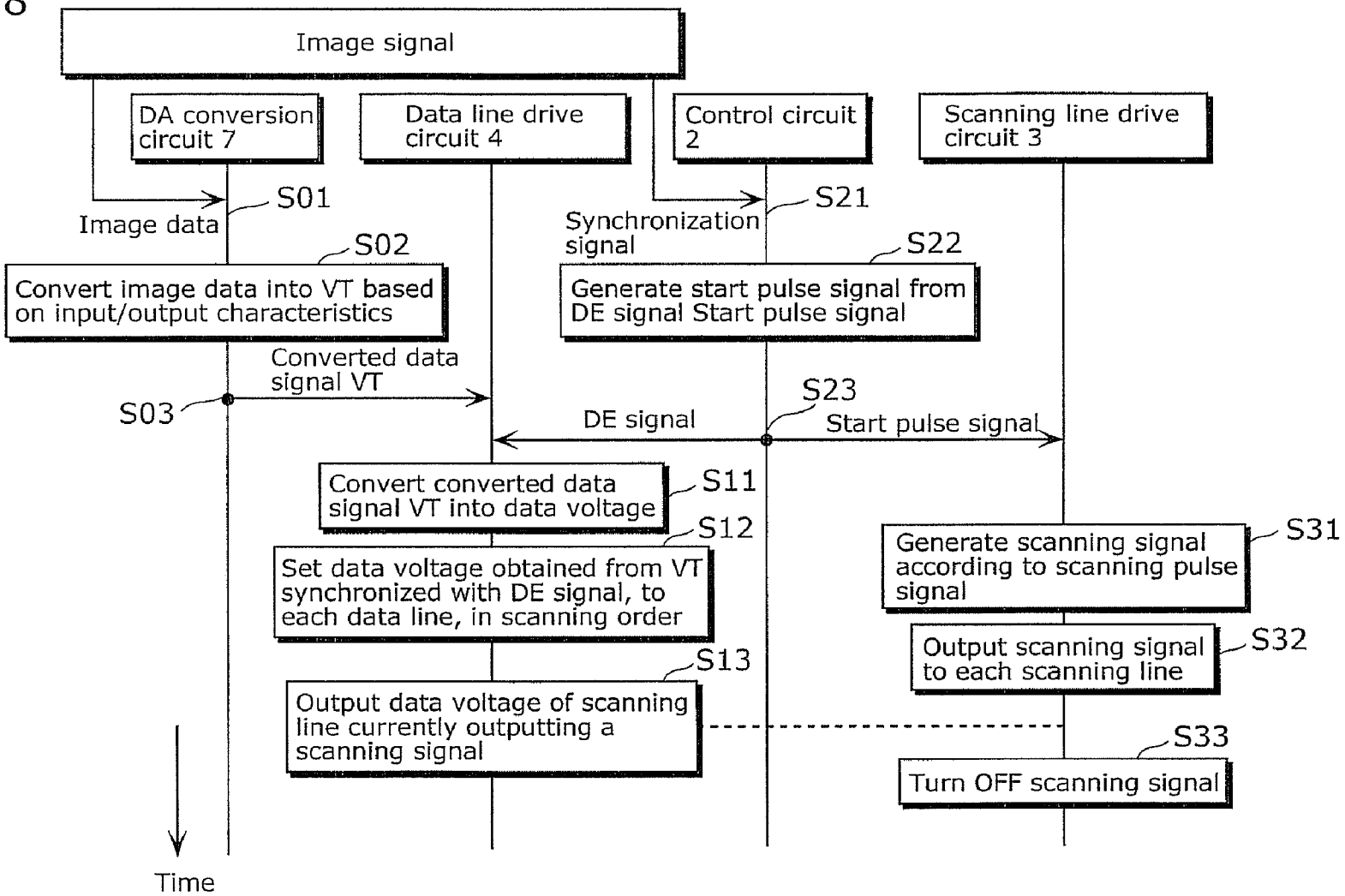
FIG. 8 is a diagram showing the relationship between the flow of operations of each circuit included in the organic EL display panel according to the embodiment of the present invention.

FIG. 8 is a diagram showing the relationship between the flow of operations of each circuit included in the organic EL display panel according to the embodiment of the present invention. The figure shows the operations centered on the control circuit 2, the scanning line drive circuit 3, the data line drive circuit 4, and the conversion circuit 7 included in the organic EL display panel 1, and the relationship between these operations.

First, an image signal is inputted from an external source, and the organic EL display panel 1 inputs the image data included in the image signal to the conversion circuit 7 (S01) and inputs the synchronization signal to the control circuit 2 (S21).

Next, the conversion circuit 7 converts the inputted image data into the converted data signal VT, based on the conversion characteristics shown in FIG. 6 (S02). Then, the conversion circuit 7 outputs the converted data signal VT resulting from the conversion to the data line drive circuit 4 (S03).

Meanwhile, the control circuit 2 to which the synchronization signal has been inputted generates a start pulse signal from the DE signal included in the inputted synchronization signal (S22).

Next, the control signal 2 outputs the DE signal to the data line drive circuit 4 and outputs the generated start pulse signal to the scanning line drive circuit 3 (S23).

Next, the data line drive circuit 4 to which the DE signal has been inputted converts, through the built-in DA conversion circuit 41, the converted data signal VT outputted from the conversion circuit 7 into the data voltage Vdata (S11).

Next, the data line drive circuit 4 sequentially sets the DA-converted data voltage to respective data drivers in synchronization with the DE signal, on a data line basis and according to the scanning sequence (S12).

Meanwhile, the scanning line drive circuit 3 to which the start pulse signal has been inputted generates a scanning signal SCAN according to the start pulse signal (S31).

Next, the scanning line drive circuit 3 outputs the generated scanning signal SCAN to each of the scanning lines (S32).

The data line drive circuit 4 outputs the data voltage of a luminescence pixel connected to a scanning line that has switched to the high level according to the scanning signal SCAN outputted from the scanning line drive circuit 3 (S13).

Lastly, the scanning line drive circuit 3 switches, to the low level, the scanning lines switched to the high level in step S13 (S33).

Hereinafter, the circuit operation of a luminescence pixel to which the scanning signal SCAN and the data voltage Vdata have been inputted from the scanning line drive circuit 3 and the data line drive circuit 4, respectively.

Figure 9:
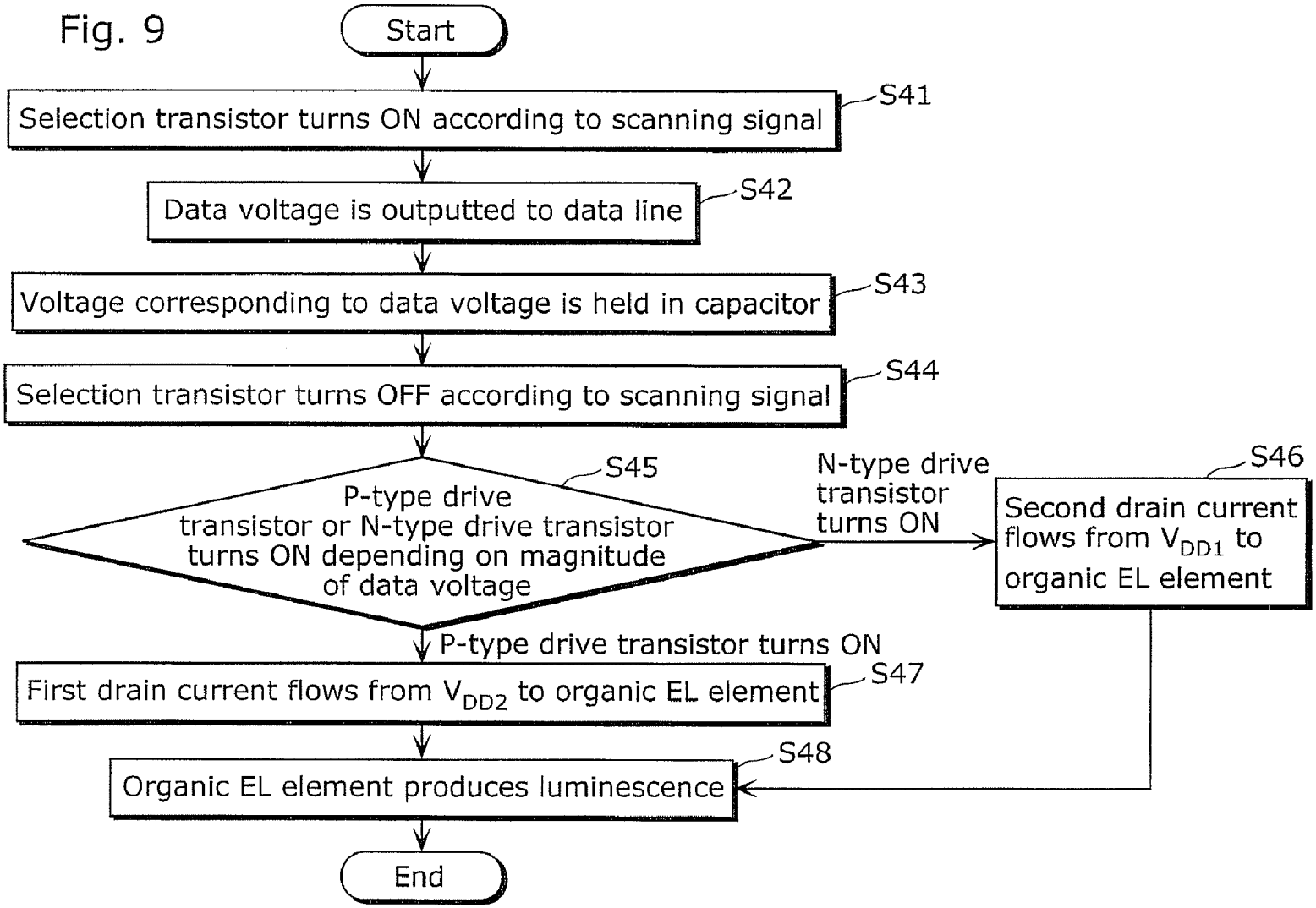
FIG. 9 is an operation flowchart for a luminescence pixel circuit according to the embodiment of the present invention.

FIG. 9 is an operation flowchart for a luminescence pixel circuit according to the embodiment of the present invention.

First, the scanning line 11 switches to the high level according to the scanning signal SCAN, and the selection transistor 21 of the luminescence pixel 6A becomes conductive (S41).

Next, the data voltage of the luminescence pixel 6A is outputted from the data line drive circuit 4 to the data line 12 (S42).

According to step 41 and step 42, a voltage corresponding to the data voltage is held in the capacitor 24 of the luminescence pixel 6A (S43).

Next, the scanning line 11 switches to the low level according to the scanning signal SCAN, and the selection transistor 21 of the luminescence pixel 6A becomes non-conductive (S44).

Next, the P-type drive transistor 22 or the N-type drive transistor 23 automatically turns ON depending on the magnitude of the applied data voltage (S45).

When the P-type drive transistor 22 turns ON in step S45, the first drain current flows from the first power source line 14 to the organic EL element 25 via the P-type drive transistor 22, with the low voltage $V_{DD2}$ as the power source voltage. On the other hand, when the N-type drive transistor 23 turns ON in step S45, the second drain current flows from the second power source line 13 to the organic EL element 25 via the N-type drive transistor 23, with the high voltage $V_{DD1}$ as the power source voltage.

According to step S46 or step S47, the organic EL element 25 produces luminescence in response to the data voltage.

Figure 10:
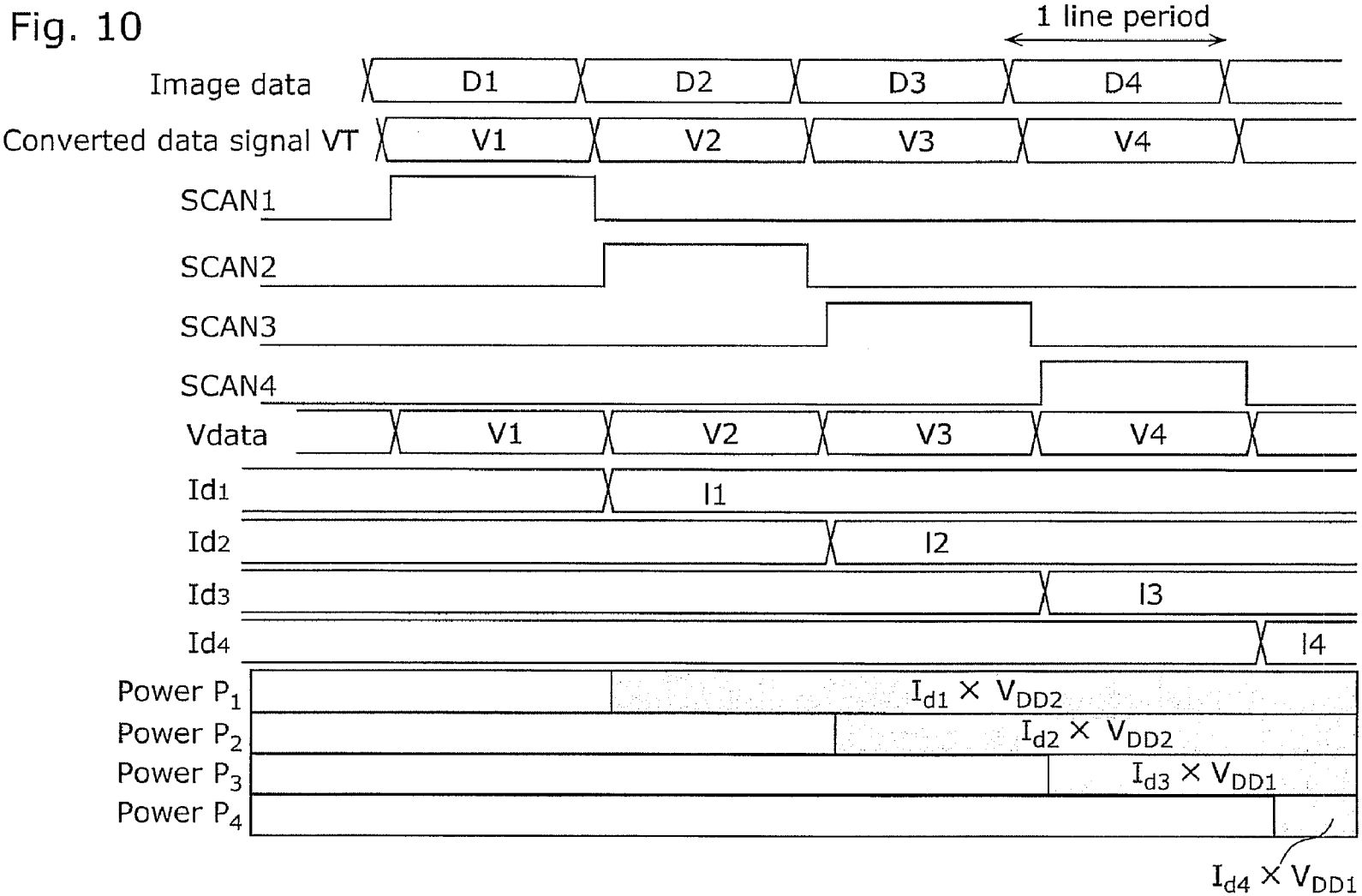
FIG. 10 is an example of a drive timing chart for describing in detail the driving operation of the organic EL display panel according to the embodiment of the present invention.

FIG. 10 is an example of a drive timing chart for describing in detail the driving operation of the organic EL display panel according to the embodiment of the present invention. The drive timing chart shown in the figure is an excerpt of four horizontal periods for four pixels of the same data line in the drive timing chart shown in FIG. 7B, in which specific data voltage values have been set. The image data corresponding to the first to fourth rows are D1 to D4, respectively. Furthermore, the converted data signals VT and data voltages corresponding to D1 to D4 are V1 to V4. Furthermore, the drain currents flowing to the organic EL element 25 according to the data voltages V1 to V4 are Id1 to Id4, respectively.

Figure 11:
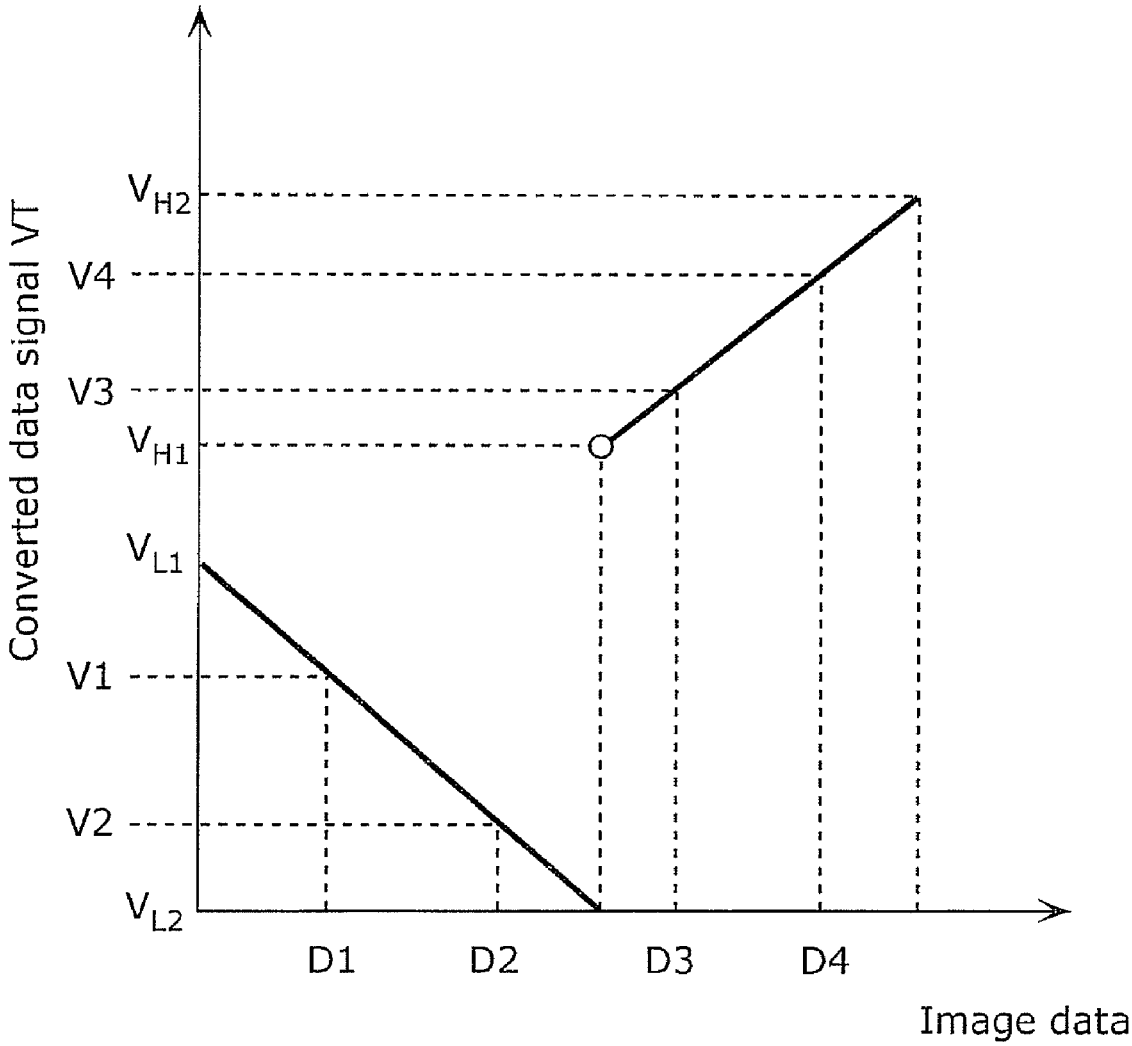
FIG. 11 is a graph representing an example of the conversion characteristics of the conversion circuit according to the embodiment of the present invention.

Each of the image data D1 to D4 are converted into a converted data signal VT and a data voltage, according to the conversion characteristics shown in FIG. 11.

FIG. 11 is a graph representing an example of conversion characteristics of the conversion circuit according to the embodiment of the present invention. As shown in the figure, with the image data D1 to D4, the grayscale level increases sequentially, from D1 which is a low grayscale level to D4 which is a high grayscale level. Using the conversion characteristic region in which data voltage becomes lower as the image data becomes a higher grayscale level, D1 and D2 are converted into V1 and V2, respectively. In contrast, using the conversion characteristic region in which data voltage becomes higher as the image data becomes a higher grayscale level, D3 and D4 are converted into V3 and V4, respectively.

Figure 12:
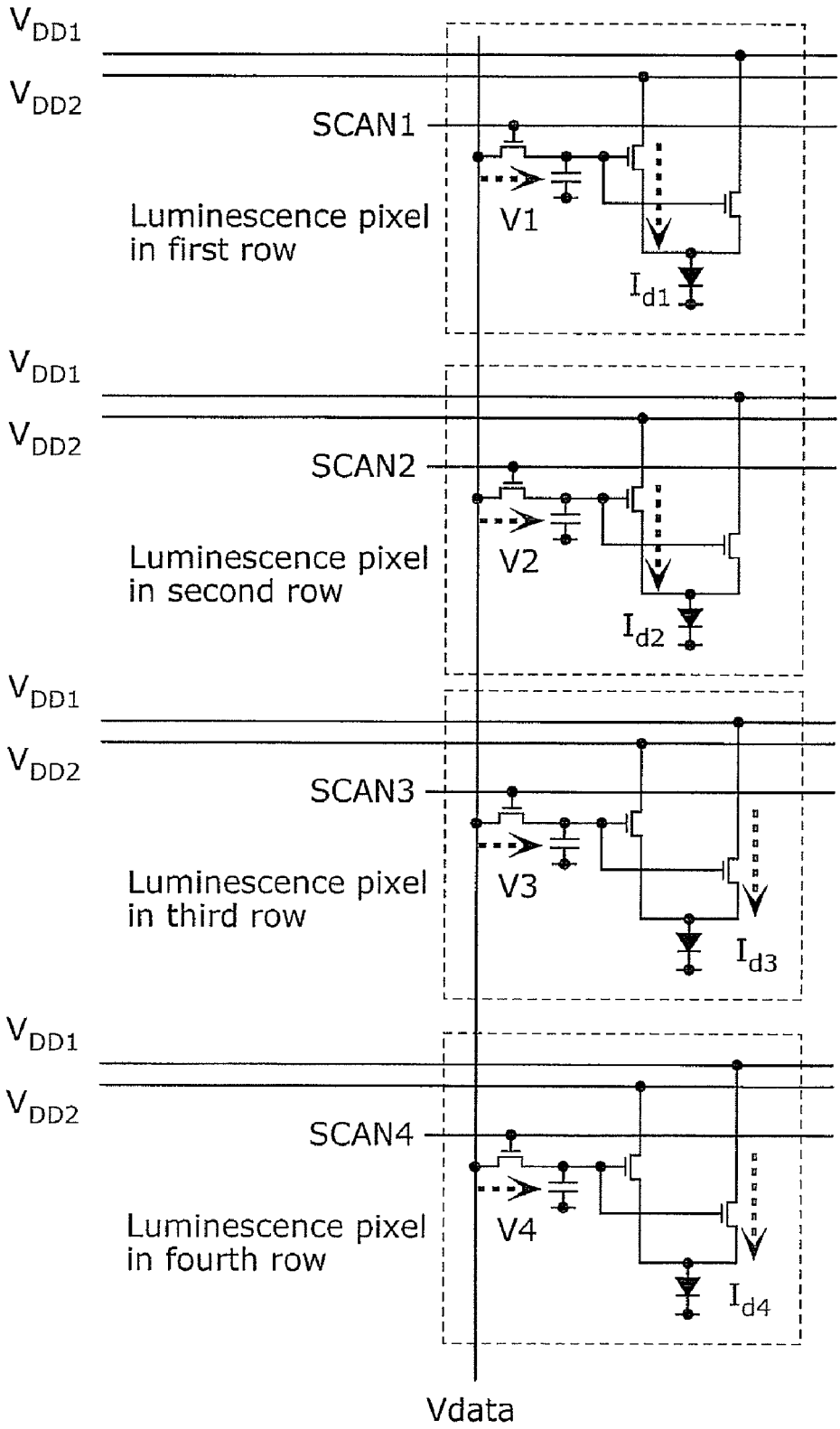
FIG. 12 is a diagram showing the circuit state of luminescence pixels in adjacent rows according to the embodiment of the present invention.

FIG. 12 is a diagram showing the circuit state of luminescence pixels in adjacent rows according to the embodiment of the present invention. The figure shows the paths through which the drain current flows when the data voltages V1 to V4 corresponding to the image data D1 to D4 described above are respectively written into a first row luminescence pixel to a fourth row luminescence pixel.

Figure 13:
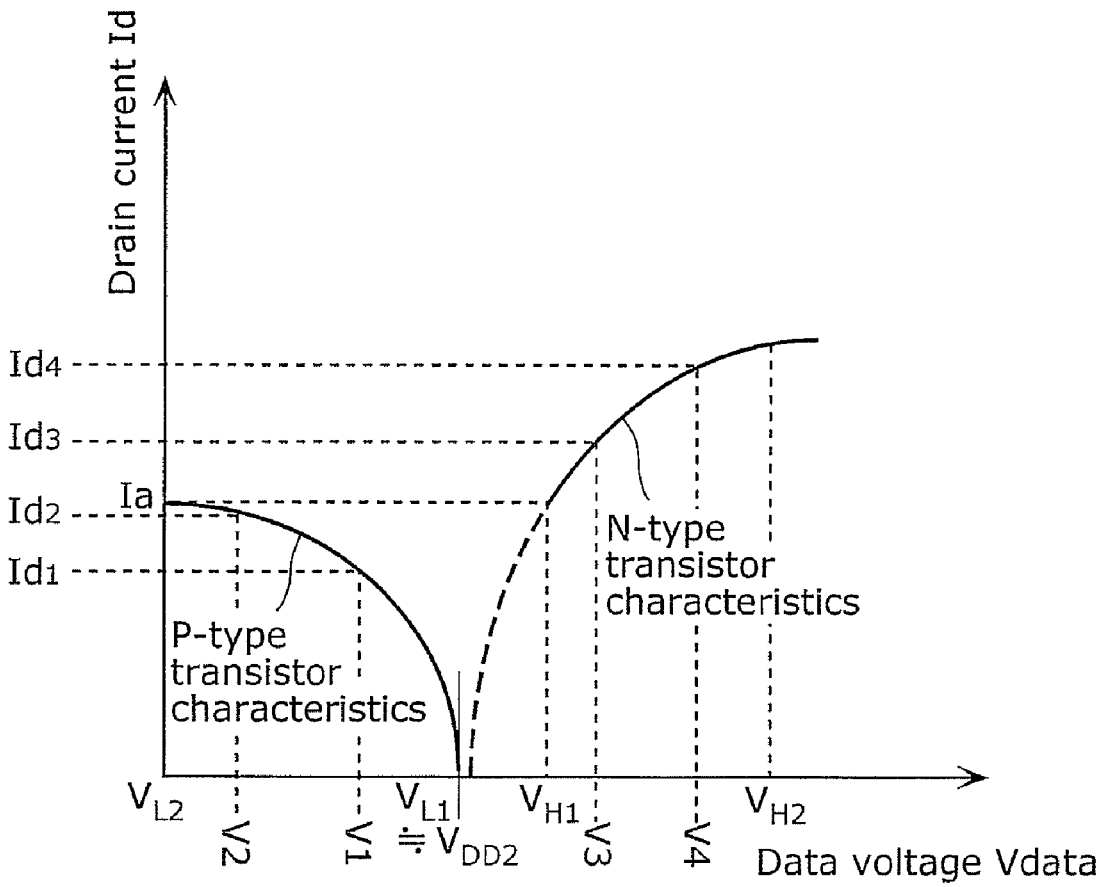
FIG. 13 is a graph representing an example of the current-voltage characteristics of the two drive transistors according to the embodiment of the present invention.

Furthermore, FIG. 13 is a graph representing an example of the current-voltage characteristics of the two drive transistors according to the embodiment of the present invention. The figure shows the current-voltage characteristics of a luminescence pixel expressed through the two drive transistors. Furthermore, the figure shows the size of the drain currents Id1 to Id4 when the above-described data voltages V1 to V4 are respectively written into the first row luminescence pixel to the fourth row luminescence pixel.

The graphs shown in FIG. 11 to FIG. 13 show that the low grayscale level image data D1 and D2 are respectively converted into V1 and V2 by the conversion circuit 7, and that, since V1 and V2 are in the range of $V_{L2}$ to $V_{L1}$, first drain currents Id1 and Id2 respectively flow to the organic EL element 25 from the P-type drive transistor 22, with the low voltage $V_{DD2}$ as the power source voltage. Furthermore, the above graphs show that the high grayscale level image data D3 and D4 are respectively converted into V3 and V4 by the conversion circuit 7, and that, since V3 and V4 are in the range of $V_{H1}$ to $V_{H2}$, second drain currents Id3 and Id4 respectively flow to the organic EL element 25 from the N-type drive transistor 23, with the voltage $V_{DD1}$ as the power source voltage.

Returning to FIG. 10, the drive timing chart shall once again be described. The image data D1 to D4 are respectively converted to the converted data signals and data voltages V1 to V4, the data V1 to V4 resulting from the conversion are written into the luminescence pixel of the respective rows in synchronization with the scanning signals SCAN1 to SCAN4 of the first to fourth rows, the drain currents Id1 to Id 4 are generated in the respective luminescence pixels from the time of completion of the writing operation onward, and the organic EL elements 25 produce luminescence. According to the above-described operation, the power consumption P1 to P4 occurring in the respective luminescence pixels in the first to fourth rows in one frame period is represented below.

$$P1 = Id1 \times V_{DD2} \quad \text{(Equation 1)}$$

$$P2 = Id2 \times V_{DD2} \quad \text{(Equation 2)}$$

$$P3 = Id3 \times V_{DD1} \quad \text{(Equation 3)}$$

$$P4 = Id4 \times V_{DD1} \quad \text{(Equation 4)}$$

According to equations 1 to 4, the first power source line 14 for applying the low voltage $V_{DD2}$ is used in the display operation for the low grayscale level image data D1 and D2. Here, in the case of the conventional circuit configuration in which the flow of the drain current corresponding to image data of all grayscale levels is effected by one drive transistor, the second power source line 13 for applying the high voltage $V_{DD1}$ is used at all times. Comparing both configurations, selectively using the power source lines according to the display grayscale levels at which the two drive transistors are arranged, as in the organic EL display panel 1 according to the present invention, allows for the lowering of power consumption in the entire panel because power consumption when displaying the low grayscale level image data D1 and D2 is reduced.

Although an embodiment has been described thus far, the organic EL display panel according to the present invention is not limited to the above-described embodiment. The present invention includes other embodiments implemented through a combination of arbitrary elements of the above-described embodiment, or modifications obtained through the application of various modifications to the above-described embodiment and the modifications thereto, that may be conceived by a person of ordinary skill in the art, that do not depart from the essence of the present invention, or organic EL display devices in which the organic EL display panel according to the present invention is built into.

For example, although the above-described embodiment adopts a configuration in which the source electrode and the drain electrode of the two drive transistors are connected to the anode of the organic EL element 25, and the two drive transistors are in a higher potential-side than the organic EL element 25, the present invention is not limited to such configuration. Hereinafter, a modification of the circuit configuration of the luminescence pixel 6A shown in the above-described embodiment shall be described.

Figure 14:
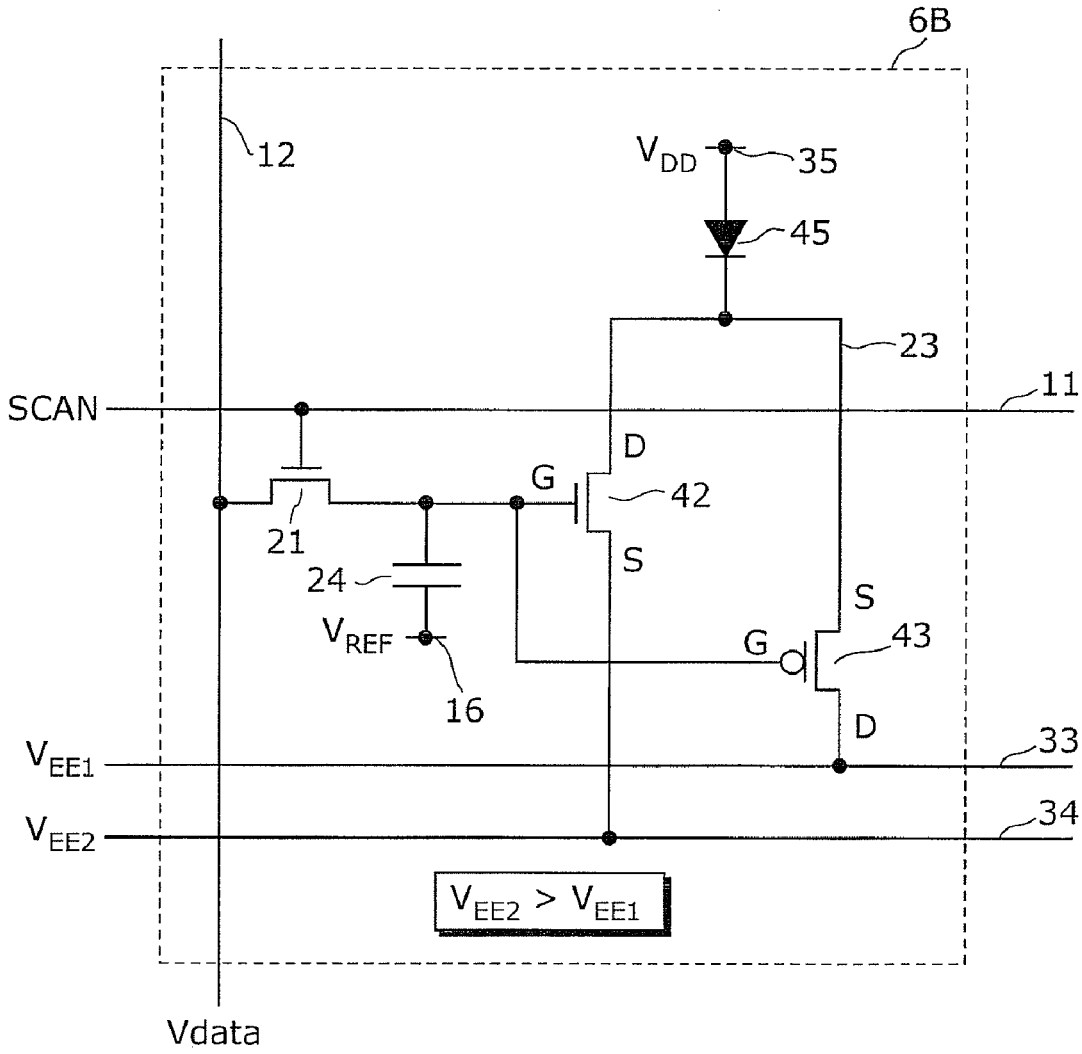
FIG. 14 is a circuit diagram of a luminescence pixel illustrating a modification of the embodiment of the present invention.

FIG. 14 is a circuit diagram of a luminescence pixel illustrating a modification of the embodiment of the present invention. The luminescence pixel 6B shown in the figure is different from the luminescence pixel 6A shown in the embodiment only in the adoption of a configuration in which the cathode of an organic EL element 45 and the source electrode or the drain electrode of the two drive transistors are connected, and the two drive transistors are in a lower potential-side than the organic EL element 45.

The organic EL display panel including the luminescence pixel 6B illustrated in FIG. 14 produces the same advantageous effect as the organic EL display panel 1 according to the above-described embodiment. Hereinafter, description shall not be repeated for points identical to those in the configuration of the luminescence pixel 6A, and shall focus on the points of difference.

The luminescence pixel 6B illustrated in FIG. 14 includes the selection transistor 21, an N-type drive transistor 42, a P-type drive transistor 43, the capacitor 24, and the organic EL element 45. Furthermore, the data line 12 is provided on a luminescence pixel column basis, and the scanning line 11 is provided on a luminescence pixel row basis.

In addition, a first power source line 34, a second power source line 33, a standard power source line 35, and the reference power source line 16 are provided to all the luminescence pixels 6B. Furthermore, each of the first power source line 34, the second power source line 33, the standard power source line 35, and the reference power source line 16 is also connected to the other luminescence pixels, and to the power source supply circuit 5. Furthermore, a high voltage $V_{EE2}$ that is set to the first power source line 34 is set higher than a low voltage $V_{EE2}$ that is set to the second power source line 33, and both the second power source line 34 and the first power source line 33 are set to a lower potential than the standard power source line 35.

The selection transistor 21 is a switching transistor having gate electrode connected to the scanning line 11, and one of a source electrode and a drain electrode connected to the respective gate electrodes of the N-type drive transistor 42 and the P-type drive transistor 43.

The N-type drive transistor 42 has a gate electrode connected to the first electrode of the capacitor 24, a drain electrode connected to the cathode of the organic EL element 45, and a source electrode connected to the first power source line 34. With the above-described connection relationship, the N-type drive transistor 42 causes the organic EL element 45 to produce luminescence by supplying the organic EL element 45 with the first drain current corresponding to the voltage held by the capacitor 24. The N-type drive transistor 42 is configured of an N-type thin film transistor (N-type TFT). Here, in the this modification, the first drain current is a current that flows from the standard power source line 35 to the first power source line 34 via the N-type drive transistor 42.

The P-type drive transistor 43 has a gate electrode connected to the first electrode of the capacitor 24, a source electrode connected to the cathode of the organic EL element 45, and a drain electrode connected to the second power source line 33. With the above-described connection relationship, the P-type drive transistor 43 causes the organic EL element 45 to produce luminescence by supplying the organic EL element 45 with the second drain current corresponding to the voltage held by the capacitor 24. The P-type drive transistor 43 is configured of a P-type thin film transistor (P-type TFT). Here, in the this modification, the second drain current is a current that flows from the standard power source line 35 to the second power source line 33 via the P-type drive transistor 43.

The organic EL element 45 is a luminescence element having a cathode connected to the drain electrode of the N-type drive transistor 42 and the source electrode of the P-type drive transistor 43, and an anode connected to the standard power source line 35. With the above-described connection relationship, the organic EL element 45 produces luminescence according to the flow of the first drain current of the N-type drive transistor 42 or the second drain current of the P-type drive transistor 43.

The capacitor 24, whose first electrode is connected to the respective gates of the N-type drive transistor 42 and the P-type drive transistor 43 and whose second electrode is connected to the reference power source line 16, holds a voltage that corresponds to the data voltage.

Here, the first drain current supplied by the N-type drive transistor 42 and the second drain current supplied by the P-type drive transistor 43 are selectively set to flow to the organic EL element 45, with a predetermined current value in the current-voltage characteristics of the organic EL element 45 as a threshold value. Specifically, by having one of the first drain current and the second drain current flow to the organic EL element 45 in each display grayscale level, either of the drain currents becomes the luminescence current of the organic EL element 45. In the luminescence pixel 6B, for example, in the low luminescence current region, the N-type drive transistor 42 turns ON, thus causing the first drain electrode to flow as the luminescence current. Furthermore, in the high luminescence current region, the P-type drive transistor 43 turns ON, thus causing the second drain current to flow as the luminescence current. As such, in the low luminescence current region, the first drain current flows from the standard power source line 35 to the second power source line 33 to which the low voltage $V_{EE1}$ is set, and to the organic EL element 45. Therefore, in the luminescence production operation in the low luminescence current region, it becomes possible to lower power consumption compared to when drain current is caused to flow to the first power source line 34.

More specifically, although the number of drive transistors increases by one compared to a normal luminescence pixel circuit, in the luminescence pixels 6B, increasing the number of drive transistors by one allows the first power source line 34 and the second power source line 43 to be selectively used according to the data voltage, without additionally providing a switching circuit for the first power source line 34 and the second power source line 33 and without providing a data line and a selection transistor for every two drive transistors. As a result, an energy-saving pixel circuit in which power consumption is lowered can be realized with a simple configuration and without significantly increasing the circuit elements of the luminescence pixel.

Figure 15:
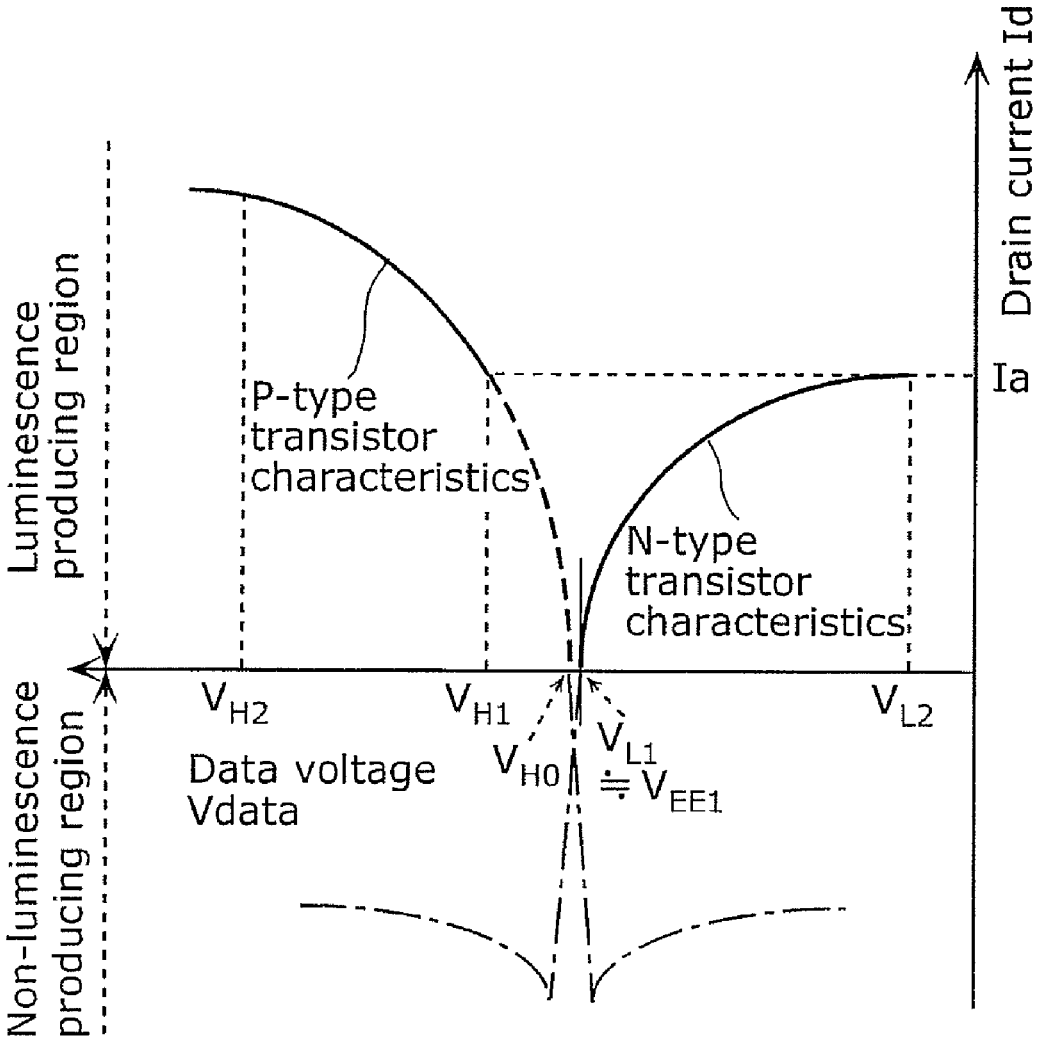
FIG. 15 is a graph representing current-voltage characteristics of two drive transistors included in the luminescence pixel shown in the modification of the embodiment of the present invention.

FIG. 15 is a graph representing current-voltage characteristics of the two drive transistors included in the luminescence pixel shown in the modification of the embodiment of the present invention. Here, in the modification, the first gate voltage value is $V_{L2}$, the second gate voltage value is $V_{H1}$, the third gate voltage value is $V_{H0}$, and the fourth gate voltage value is $V_{L1}$.

The N-type drive transistor 42 has current-voltage characteristics such that the first gate voltage value $V_{L2}$ when the current Ia in the current-voltage characteristics of the organic EL element shown in FIG. 3 is caused to flow as the first drain current is a maximum voltage in a range of data voltages for expressing display grayscale levels, and that the lesser the first drain current is than the current Ia, the lower the gate voltage for causing the first drain current to flow becomes. Stated differently, the N-type drive transistor 42 has current-voltage characteristics such that the first drain current increases as the gate voltage increases.

On the other hand, the P-type drive transistor 43 has current-voltage characteristics such that the second gate voltage value $V_{H1}$ when the current Ia is caused to flow as the second drain current is a voltage value that is less than the third gate voltage value $V_{H0}$ corresponding to a minimum current value Imin that is caused to flow to the organic EL element 45, and that the greater the second drain current is than the current Ia, the lower the gate voltage for causing the second drain current to flow becomes. Stated differently, the P-type drive transistor 43 has current-voltage characteristics such that the second drain current decreases as the gate voltage increases. Here, the current value Imin is the current value on the horizontal axis in the current-voltage characteristics shown in FIG. 15, and, in terms of luminescence currents, those currents that are smaller than the current value Imin can be disregarded.

It should be noted that it is preferable that the fourth gate voltage value $V_{L1}$ corresponding to the minimum current Imin, in the current-voltage characteristics be set higher than the third gate voltage value $V_{H0}$.

With this, the range of gate voltages for causing the first drain current of the N-type drive transistor 42 to flow and the range of gate voltages for causing the second drain current of the P-type drive transistor 43 to flow do not overlap and are completely separated. With this, it becomes possible to cause the organic EL element 45 to produce luminescence according to the drain current supplied from either one of the drive transistors only, for the entire range of data voltages, without additionally providing a switching circuit for the high-voltage power source line and the low-voltage power source line.

Figure 16:
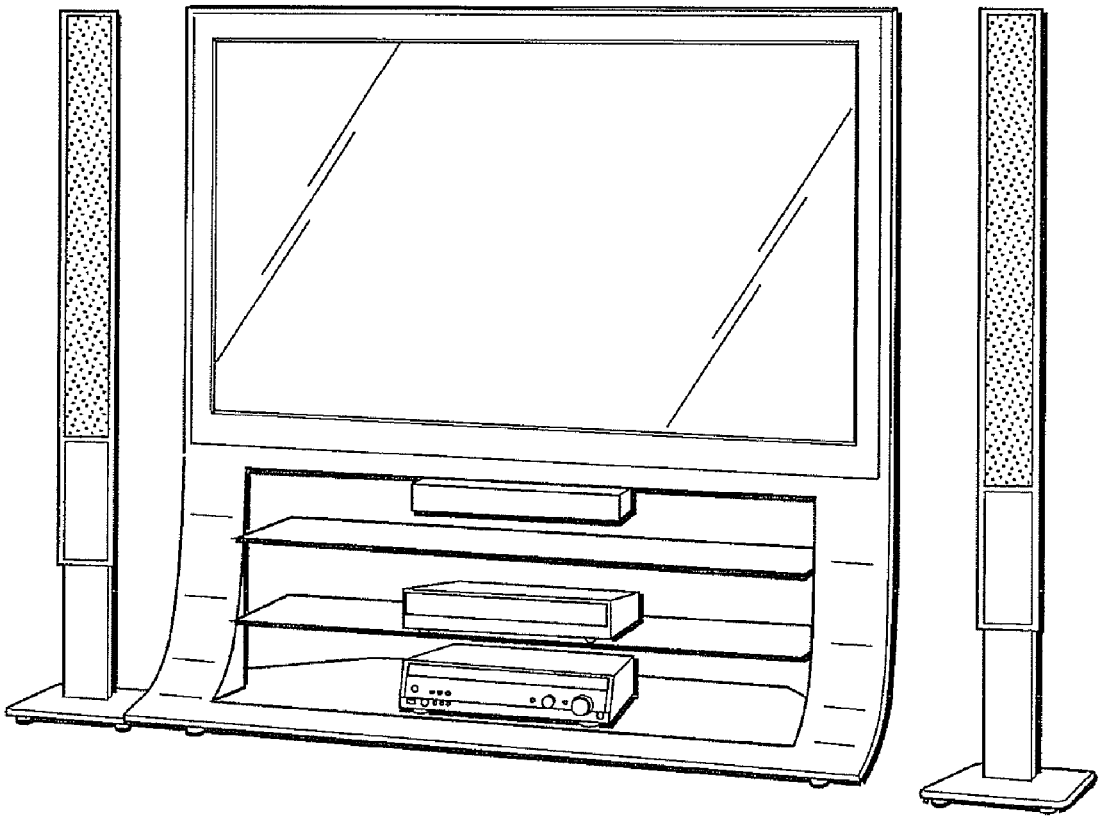
FIG. 16 is an outline view of a thin, flat TV in which the organic EL display panel according to the present invention is built into.
Figure 17:
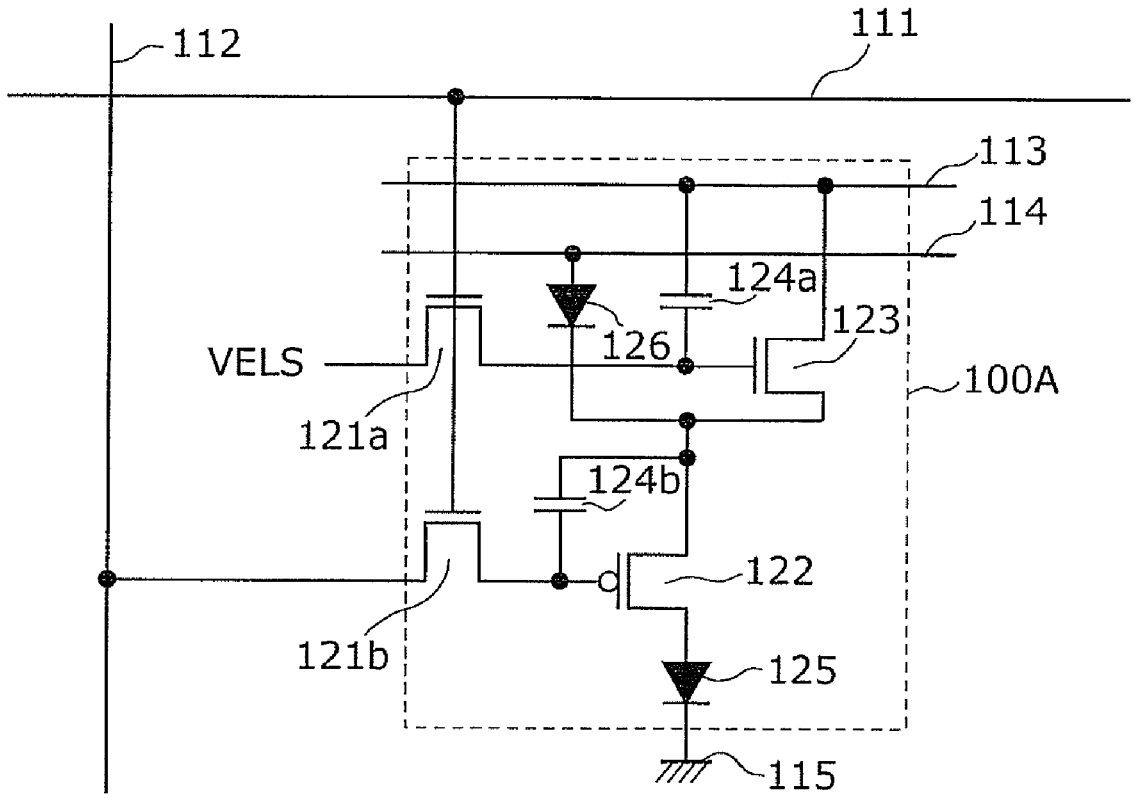
FIG. 17 is a circuit diagram showing an example of a specific circuit configuration of a pixel circuit included in an organic EL display device disclosed in Patent Reference 1.

Furthermore, for example, the organic EL display panel according to the present invention is built into a thin, flat TV shown in FIG. 16. A thin, flat TV capable of low power consumption and high-accuracy image display is implemented by having the organic EL display panel according to the present invention built into the TV.

Although only an exemplary embodiment of this invention has been described in detail above, those skilled in the art will readily appreciate that many modifications are possible in the exemplary embodiment without materially departing from the novel teachings and advantages of this invention. Accordingly, all such modifications are intended to be included within the scope of this invention.

INDUSTRIAL APPLICABILITY

The present invention is particularly useful in an active-type organic EL flat panel display which causes luminance to fluctuate by controlling pixel luminescence production intensity according to a pixel signal current.

What is claimed is:

1. An organic electroluminescence (EL) display panel, comprising:

an organic EL element;

a capacitor that includes a first electrode and a second electrode, and holds a voltage corresponding to a data voltage;

a first drive transistor that is of a P-type and includes a gate electrode connected to the first electrode of the capacitor and a drain electrode connected to an anode electrode of the organic EL element, the first drive transistor causing the organic EL element to produce a luminescence by supplying the organic EL element with a first drain current corresponding to the voltage held by the capacitor;

a second drive transistor that is of an N-type and includes a gate electrode connected to the first electrode of the capacitor and a source electrode connected to the anode of the organic EL element, the second drive transistor causing the organic EL element to produce the luminescence by supplying the organic EL element with a second drain current corresponding to the voltage held by the capacitor;

a data line for supplying the data voltage;

a switching transistor that causes the capacitor to hold the voltage, by switching between conduction and non-conduction between the data line and the capacitor;

a first power source line for applying a first power source voltage to a source electrode of the first drive transistor; and a second power source line for applying, to a drain electrode of the second drive transistor, a second power source voltage which is higher than the first power source voltage, wherein the first drive transistor has current-voltage characteristics such that a first gate voltage value corresponding to a predetermined current value in current-voltage characteristics of the organic EL element is a minimum voltage of the data voltage, and that the lesser the first drain current is than the predetermined current value, the higher a gate voltage for causing the first drain current to flow becomes, and the second drive transistor has current-voltage characteristics such that a second gate voltage value corresponding to the predetermined current value is a voltage value greater than a third gate voltage value corresponding to a minimum value of a current that is caused to flow to the organic EL element, and that the greater the second drain current is than the predetermined current value, the higher a gate voltage for causing the second drain current to flow becomes.

2. The organic EL display panel according to claim 1, wherein, in the current-voltage characteristics of the first drive transistor, a fourth gate voltage value corresponding to a minimum value of a current that is caused to flow to the organic EL element is less than the third gate voltage value.

3. The organic EL display panel according to claim 2, further comprising:

a conversion circuit that converts image data into a converted data signal; and a data line drive circuit that supplies the data voltage to the data line, and includes a digital-to-analog (DA) conversion circuit that converts, into the data voltage, the converted data signal inputted from the conversion circuit.

4. The organic EL display panel according to claim 3, wherein, when the data voltage corresponding to the converted data signal is within a range that is from the first gate voltage value to the fourth gate voltage value in the current-voltage characteristics of the first drive transistor, the conversion circuit converts the image data into the converted data signal such that a data voltage after the conversion decreases as a display grayscale level of the image data corresponding to the range increases, and when the data voltage corresponding to the converted image data signal is within a range that is equal to or greater than the second gate voltage value in the current-voltage characteristics of the second drive transistor, the conversion circuit converts the image data into the converted data signal such that the data voltage after the conversion increases as the display grayscale level of the image data corresponding to the range increases.

5. The organic EL display panel according to claim 3, further comprising a scanning line drive circuit that outputs, to the switching transistor via a scanning line, a scanning signal for controlling conduction and non-conduction of the switching transistor.

6. The organic EL display panel according to claim 5, wherein pixel circuits, each including the organic EL element, the capacitor, the first drive transistor, and the second drive transistor, are arranged in a matrix.

7. The organic EL display panel according to claim 6, further comprising a control circuit that controls the data line drive circuit and the scanning line drive circuit, wherein the control circuit controls synchronizing of:

a timing for turning ON of the switching transistor included in respective pixel circuits in one line of the matrix, through the scanning line drive circuit; and a timing for supplying of the data voltage to the respective pixel circuits in the one line of the matrix via the data line, through the data line drive circuit.

8. The organic EL display panel according to claim 7, wherein the data line drive circuit supplies, according to a synchronization signal from the control circuit, the respective pixel circuits in the one line of the matrix with the data voltage via the data line, in synchronization with a timing for outputting the scanning signal from the scanning line drive circuit to the respective pixel circuits in the one line.

9. An organic EL display device comprising the organic EL display panel according to claim 1.

10. A method of driving an organic EL display panel which includes:

an organic EL element;

a capacitor that includes a first electrode and a second electrode, and holds a voltage corresponding to a data voltage;

a first drive transistor that is of a P-type and includes a gate electrode connected to the first electrode of the capacitor and a drain electrode connected to an anode of the organic EL element, the first drive transistor causing the organic EL element to produce a luminescence by supplying the organic EL element with a first drain current corresponding to the voltage held by the capacitor;

a second drive transistor that is of an N-type and includes a gate electrode connected to the first electrode of the capacitor and a source electrode connected to the anode of the organic EL element, the second drive transistor causing the organic EL element to produce the luminescence by supplying the organic EL element with a second drain current corresponding to the voltage held by the capacitor;

a data line for supplying the data voltage;

a switching transistor that causes the capacitor to hold the voltage, by switching between conduction and non-conduction between the data line and the capacitor;

a first power source line for applying a first power source voltage to a source electrode of the first drive transistor;

a second power source line for applying, to a drain electrode of the second drive transistor, a second power source voltage which is higher than the first power source voltage;

a conversion circuit that converts image data into a converted data signal; and a data line drive circuit that supplies the data voltage to the data line, and includes a digital-to-analog (DA) conversion circuit that converts, into the data voltage, the converted data signal inputted from the conversion circuit, wherein the first drive transistor has current-voltage characteristics such that a first gate voltage value corresponding to a predetermined current value in current-voltage characteristics of the organic EL element is a minimum voltage of the data voltage, and that the lesser the first drain current is than the predetermined current value, the higher a gate voltage for causing the first drain current to flow becomes, and the second drive transistor has current-voltage characteristics such that a second gate voltage value corresponding to the predetermined current value is a voltage value greater than a third gate voltage value corresponding to a minimum value of a current that is caused to flow to the organic EL element, and that the greater the second drain current is than the predetermined current value, the higher a gate voltage for causing the second drain current to flow becomes, the method comprising:

converting, when the data voltage corresponding to the converted data signal is within a range that is from the first gate voltage value to the fourth gate voltage value corresponding to the minimum value of a current that is caused to flow to the organic EL element in the current-voltage characteristics of the first drive transistor, the image data into the converted data signal such that a data voltage after the conversion decreases as a display grayscale level of the image data corresponding to the range increases, the converting being performed by the conversion circuit, and converting, when the data voltage corresponding to the converted image data signal is within a range that is equal to or greater than the second gate voltage value in the current-voltage characteristics of the second drive transistor, the image data into the converted data signal such that the data voltage after the conversion increases as the display grayscale level of the image data corresponding to the range increases, the converting being performed by the conversion circuit.

11. An organic EL display panel, comprising:

an organic EL element;

a capacitor that includes a first electrode and a second electrode, and holds a voltage corresponding to a data voltage;

a first drive transistor that is of an N-type and includes a gate electrode connected to the first electrode of the capacitor and a drain electrode connected to a cathode of the organic EL element, the first drive transistor causing the organic EL element to produce a luminescence by supplying the organic EL element with a first drain current corresponding to the voltage held by the capacitor;

a second drive transistor that is of a P-type and includes a gate electrode connected to the first electrode of the capacitor and a source electrode connected to the cathode of the organic EL element, the second drive transistor causing the organic EL element to produce the luminescence by supplying the organic EL element with a second drain current corresponding to the voltage held by the capacitor;

a data line for supplying the data voltage;

a switching transistor that causes the capacitor to hold the voltage, by switching between conduction and non-conduction between the data line and the capacitor;

a first power source line for applying a first power source voltage to a source electrode of the first drive transistor; and a second power source line for applying, to a drain electrode of the second drive transistor, a second power source voltage which is higher than the first power source voltage, wherein the first drive transistor has current-voltage characteristics such that a first gate voltage value corresponding to a predetermined current value in current-voltage characteristics of the organic EL element is a maximum value of the data voltage, and that the lesser the first drain current is than the predetermined current value, the lower a gate voltage for causing the first drain current to flow becomes, and the second drive transistor has current-voltage characteristics such that a second gate voltage value corresponding to the predetermined current value is a voltage value greater than a third gate voltage value corresponding to a minimum value of a current that is caused to flow to the organic EL element, and that the greater the second drain current is than the predetermined current value, the lower a gate voltage for causing the second drain current to flow becomes.

* * * * *